US007775906B2

(12) United States Patent
Kusumoto

(10) Patent No.: US 7,775,906 B2
(45) Date of Patent: Aug. 17, 2010

(54) GOLF CLUB

(75) Inventor: Harunobu Kusumoto, Higashikurume (JP)

(73) Assignee: Daiwa Seiko, Inc., Tokyo (JP)

( * ) Notice: Subject to any disclaimer, the term of this patent is extended or adjusted under 35 U.S.C. 154(b) by 61 days.

(21) Appl. No.: 11/879,518

(22) Filed: Jul. 18, 2007

(65) Prior Publication Data

US 2008/0020858 A1 Jan. 24, 2008

(30) Foreign Application Priority Data

Jul. 19, 2006 (JP) ..... 2006-197222
Dec. 15, 2006 (JP) ..... 2006-337992

(51) Int. Cl.
*A63B 53/04* (2006.01)

(52) U.S. Cl. ..... 473/342; 473/345; 473/346

(58) Field of Classification Search ..... 473/324–350
See application file for complete search history.

(56) References Cited

U.S. PATENT DOCUMENTS 572,436 A * 12/1896 Mills ..... 473/346
1,253,700 A * 1/1918 McLaughlin ..... 473/288
1,582,836 A * 4/1926 Link ..... 473/346
2,087,685 A * 7/1937 Hackney ..... 473/349
3,368,812 A * 2/1968 Baldwin, Sr. ..... 473/330
4,489,945 A * 12/1984 Kobayashi ..... 473/346
4,511,145 A * 4/1985 Schmidt ..... 473/346
4,602,787 A * 7/1986 Sugioka et al. ..... 473/338
5,000,454 A * 3/1991 Soda ..... 473/346
5,163,682 A * 11/1992 Schmidt et al. ..... 473/332
5,221,087 A * 6/1993 Fenton et al. ..... 473/342
5,328,184 A * 7/1994 Antonious ..... 473/292
5,362,055 A * 11/1994 Rennie ..... 473/342
5,377,985 A * 1/1995 Ohnishi ..... 473/324
5,405,137 A * 4/1995 Vincent et al. ..... 473/342
5,407,202 A * 4/1995 Igarashi ..... 473/342
5,497,993 A * 3/1996 Shan ..... 473/329
5,533,729 A * 7/1996 Leu ..... 473/346
5,669,829 A * 9/1997 Lin ..... 473/346
5,709,615 A * 1/1998 Liang ..... 473/324
5,711,722 A * 1/1998 Miyajima et al. ..... 473/346
5,718,641 A * 2/1998 Lin ..... 473/224
5,718,645 A * 2/1998 Chang ..... 473/342
5,766,092 A * 6/1998 Mimeur et al. ..... 473/329
5,766,094 A * 6/1998 Mahaffey et al. ..... 473/342
5,908,356 A * 6/1999 Nagamoto ..... 473/224
5,908,357 A * 6/1999 Hsieh ..... 473/327

(Continued)

FOREIGN PATENT DOCUMENTS

JP 4-135576 5/1992

(Continued)

*Primary Examiner*—Alvin A Hunter
(74) *Attorney, Agent, or Firm*—McGinn IP Law Group, PLLC

(57) ABSTRACT

A golf club has a shaft, and a head of a hollow structure fixed to an end of the shaft to be set to have a predetermined lie angle and a predetermined loft angle with respect to a reference horizontal plane. The head has a face portion which includes a ball hitting surface by which a ball is hit, a crown portion, a side portion, and a sole portion. A rib is provided at a part, which is lower than a central part of the face portion, on an inner surface of the face portion to protrude toward the center of the head.

25 Claims, 12 Drawing Sheets

U.S. PATENT DOCUMENTS

| | | | | | |
|---|---|---|---|---|---|
| 5,941,782 | A * | 8/1999 | Cook | 473/346 |
| 5,971,868 | A * | 10/1999 | Kosmatka | 473/349 |
| 6,193,614 | B1 * | 2/2001 | Sasamoto et al. | 473/329 |
| 6,203,449 | B1 * | 3/2001 | Kenmi | 473/346 |
| 6,267,691 | B1 * | 7/2001 | Dammen | 473/329 |
| 6,315,678 | B1 * | 11/2001 | Teramoto | 473/291 |
| 6,379,262 | B1 * | 4/2002 | Boone | 473/324 |
| 6,605,007 | B1 * | 8/2003 | Bissonnette et al. | 473/329 |
| 6,926,618 | B2 * | 8/2005 | Sanchez et al. | 473/329 |
| 6,984,180 | B2 * | 1/2006 | Hasebe | 473/291 |
| 7,137,907 | B2 * | 11/2006 | Gibbs et al. | 473/329 |
| 7,169,062 | B2 * | 1/2007 | Chen | 473/342 |
| 7,235,023 | B2 * | 6/2007 | Sugimoto | 473/291 |
| 7,407,448 | B2 * | 8/2008 | Stevens et al. | 473/329 |
| 7,442,132 | B2 * | 10/2008 | Nishio | 473/342 |
| 2003/0220157 | A1 * | 11/2003 | Dennis et al. | 473/342 |
| 2004/0132544 | A1 * | 7/2004 | Doi | 473/345 |
| 2005/0075193 | A1 * | 4/2005 | Otoguro | 473/346 |
| 2005/0272524 | A1 * | 12/2005 | Oh | 473/329 |
| 2006/0019770 | A1 * | 1/2006 | Meyer et al. | 473/349 |
| 2006/0068936 | A1 * | 3/2006 | Dewhurst et al. | 473/342 |
| 2006/0293119 | A1 * | 12/2006 | Hou | 473/342 |
| 2008/0032817 | A1 * | 2/2008 | Lo | 473/342 |
| 2008/0242444 | A1 * | 10/2008 | Park et al. | 473/332 |

FOREIGN PATENT DOCUMENTS

| | | | | |
|---|---|---|---|---|
| JP | 04176478 | A | * | 6/1992 |
| JP | 05049714 | A | * | 3/1993 |
| JP | 05049715 | A | * | 3/1993 |
| JP | 08243194 | A | * | 9/1996 |
| JP | 09056852 | A | * | 3/1997 |
| JP | 09154984 | A | * | 6/1997 |
| JP | 09154985 | A | * | 6/1997 |
| JP | 09225075 | A | * | 9/1997 |
| JP | 09239074 | A | * | 9/1997 |
| JP | 09239075 | A | * | 9/1997 |
| JP | 09308713 | A | * | 12/1997 |
| JP | 10024130 | A | * | 1/1998 |
| JP | 10033728 | A | * | 2/1998 |
| JP | 10155943 | A | * | 6/1998 |
| JP | 10179815 | A | * | 7/1998 |
| JP | 11042300 | A | * | 2/1999 |
| JP | 11137733 | A | * | 5/1999 |
| JP | 11333031 | A | * | 12/1999 |
| JP | 2000093565 | A | * | 4/2000 |
| JP | 2000102632 | A | * | 4/2000 |
| JP | 2000317018 | A | * | 11/2000 |
| JP | 2001054599 | A | * | 2/2001 |
| JP | 2001087428 | A | * | 4/2001 |
| JP | 2001087430 | A | * | 4/2001 |
| JP | 2002065909 | A | * | 3/2002 |
| JP | 2002102396 | A | * | 4/2002 |
| JP | 2002191726 | A | * | 7/2002 |
| JP | 2003000773 | A | * | 1/2003 |
| JP | 2003290396 | A | * | 10/2003 |
| JP | 2003290398 | A | * | 10/2003 |
| JP | 2004-187795 | | | 7/2004 |
| JP | 2004-249086 | | | 9/2004 |
| JP | 2004-267438 | | | 9/2004 |
| JP | 2005052400 | A | * | 3/2005 |
| JP | 2006141806 | A | * | 6/2006 |
| JP | 2007185502 | A | * | 7/2007 |
| WO | WO 9922824 | A1 | * | 5/1999 |

* cited by examiner

GOLF CLUB

BACKGROUND OF THE INVENTION

The present invention relates to a golf club and, more particularly, to a golf club including a head of a hollow structure.

Hitherto, various contrivances have been made on conventional golf clubs of hollow structures so as to increase the flying distances of golf balls hit by the golf clubs. For example, JP-A-4-135576 discloses a golf club enabled to increase the flying distance of a golf ball hit with the golf club by reducing the rigidness of a crown portion of the golf club. According to this golf club, the rigidness of the crown portion is reduced, so that the crown portion bends at impact, and that a face portion is inclined to the border between the face portion and a sole, which serves as a supporting point. Consequently, a loft angle of the face portion increases to thereby reduce an amount of back spin due to a gear effect. Even in a case where the launch angle of this club is equal to those of other conventional clubs, the flying distance can be increased.

For example, JP-A-2004-187795 discloses a golf club configured so that a head of the golf club has a hollow structure, that a central part of a face portion is thick, while a peripheral part of the face portion is thin, and that a plurality of groove portions extending laterally are formed in an upper part than the central thick part of the face portion. According to this golf club, the deformation of an upper portion of the thick part at impact is larger than that of a lower portion thereof. A launch angle can be increased to a large degree. Consequently, the flying distance can be increased.

The golf club disclosed in JP-A-4-135576 is configured so that the entire face portion is inclined when hitting a ball. Accordingly, the loss of energy at hitting of a ball, the repulsion of a golf ball is lowered. Because the entire face portion bends, a launch angle cannot be so large. Consequently, there is a limit to an increase in the flying distance.

On the other hand, according to the golf club disclosed in JP-A-2004-187795, the groove portions are formed to thereby make an upper part of the face portion to easily bend, as compared with a lower part thereof. Thus, the launch angle can easily be increased. However, because the thin part is formed around the face portion, the entire face portion bends at impact. Thus, the loss of energy at hitting of a ball is large, so that the repulsion of the ball is lowered. Consequently, there is a limit to an increase in the flying distance.

Meanwhile, hitherto, various contrivances have been made on golf clubs, each of which is equipped with a head of a hollow structure, so as to increase the flying distance. It is known as one of the contrivances to cause the face portion to bend at hitting of a ball to thereby increase the flying distance. That is, when a ball is hit, the face portion bends to suppress the ball from being squashed. Consequently, the loss of energy due to the deformation of a ball is reduced. Increase in the flying distance can be achieved.

Thus, recently, a numerical value called Characteristic Time (here under referred to as a CT-value) has newly be en employed as an indicator for measuring a characteristic of the face portion of a head. The CT-value is a value measured in conformity with a pendulum test devised by the USGA (the United States Golf Association). An outline of the pendulum test is as follows. That is, a measurement apparatus disclosed in, for example, JP-A-2004-249086 is used and estimates the flexibility of a face portion by making a test piece to hit a central part of the face portion and by measuring a contact time between the face portion and the test piece. In a case where the CT-value is high, the face portion is easy to bend. The flying distance can be increased for the aforementioned reason.

A golf club disclosed in, for example, JP-A-2004-267438 is known as that designed by paying attention to such a CT-value. Further, JP-A-2004-267438 discloses a technique of shifting a maximum resilience point (i.e., a point at which the CT-value is highest) of a head from the position of the center of the face portion serving as a ball hitting surface of the head so as to form a golf club suitable for the swing form of each golfer. The head of a golf club is designed, especially, for a golfer, which is "liable to top a ball", so that the maximum resilience point is positioned lower than the center of the face portion. Consequently, increase in the flying distance can be achieved.

The latest structure of the head has tended to increase the size thereof so as to stabilize the directionality of a ball and so as to increase the inertia moment of the head. The latest structure of the head has bee designed so that even when a ball is hit at a position that is off the face portion's center from which a maximum flying distance can be obtained when the ball is hit, a certain flying distance can be obtained.

Along with increase in the size of the head as described above, there is an increasing tendency of variation in speed component of a ball with a ball hitting position of the head. That is, considering a swing supporting point (i.e., a grip position) as a center, in an up-down direction (i.e., a crown-sole direction) of the head, inevitably, the speed component at a lower side (i.e., a sole side), which is more distant from the swing supporting point, is large.

Considering the shape of the face surface of the recent enlarged head, a roll is formed as seen from a side sectional view. The upper (i.e., the closer to the crown side) the ball hitting position on the face surface, more oblique impact is made against a golf ball. The lower (i.e., the closer to the sole side) the ball hitting position on the face surface, more front impact is made against a golf ball. Therefore, regarding impact efficiency, a lower-side part of the face surface has higher impact efficiency. More particularly, a loft angle of a head is defined as an angle between a tangential line at a point on the face portion and a line perpendicular to a reference horizontal plane. Due to the aforementioned roll, in a case where this point is lower than the central position of the face portion, the loft angle at the point is small. In a case where this point is upper than the central position of the face portion, the loft angle at the point is large. That is, it is considered that the closer to the sole side at a each point on which the loft angle is small, the ball hitting position on the face surface, a tendency of making front impact against a golf ball is increased. In view of impact efficiency, it is considered that the repulsion is enhanced.

Accordingly, it is considered that the initial speed of a ball hit by the lower part of the face portion is high due to a speed-component difference in the up-down direction of the head.

Meanwhile, when a ball is hit by a golf club, a golfer can sensuously grasp the flying distance of the ball according to the speed of the ball immediately after hitting the ball. Although it is difficult to determine an actual flying distance, for example, at golf driving ranges, and on uphill and downhill slopes on golf courses, a flying distance can be determined, to some extent, according to the initial speed of a ball at the hitting of the ball. Thus, in a case where the initial speed of the ball hit by a lower-side part of the face portion of a club is high as described above, a golfer is likely to make a mistake that he feels that the ball has been hit at a hitting point at which a maximum flying distance can be obtained by the club.

However, as described above, the recent enlarged head of a club has a structure configured so that the maximum flying distance of a ball hit by the club is easily obtainable when the ball is hit by the central part of the face portion of the club. More particularly, in consideration of the relationship between the face portion and the gravity center of the head, the structure is such that the maximum flying distance of a ball hit by the club is easily obtainable when the ball is hit by a part which is slightly upper than the central part of the face portion of the club. Accordingly, the maximum performance of the club cannot fully be used by a golfer who makes a mistake that he feels that the lower-side part of the face portion of the club is an optimum hitting point at which a maximum flying distance can be obtained by the club. Consequently, the golfer recognizes the golf club as being unable to obtain a long flying distance. Thus, increase in the flying distance cannot be achieved.

Additionally, it is considered that the speed of a ball at hitting thereof is increased by designing a head so that the maximum resilience point is positioned lower than the center of the face portion, as disclosed in the JP-A-2004-267438. However, in the case of taking the shape of the head into consideration, when a ball is hit by a lower-side part from the center of the face portion, there is a limit to increase in the flying distance. That is, in the case of hitting a ball by a lower-side part from the center of the face portion, an amount of back spin is too large, due to reduction in the launch angle because of the shape of the roll of the face surface and to the gear effect caused by deviation in the up-down direction of the head around the gravity center at hitting of a ball. From a total standpoint, there is a limit to increase in the flying distance.

SUMMARY OF THE INVENTION

The invention is accomplished in view of the aforementioned problems. An object of the invention is to provide a golf club enabled to increase the repulsion of a ball by reducing the loss of energy when hitting the ball, and to increase a launch angle to thereby increase a flying distance of a ball.

An another object of the invention is to provide a golf club enabled to increase a flying distance by making a flying distance, which is expected when hitting a ball, coincide with an actual flying distance.

To achieve the foregoing objects, according to an aspect of the invention, there is provided a golf club having a shaft and a head of a hollow structure fixed to an end of the shaft so as to be set to have a predetermined lie angle and a predetermined loft angle with respect to a reference horizontal plane. This golf club features that the head has a face portion which includes a ball hitting surface by which a ball is hit, a crown portion, a side portion, and a sole portion, and that a rib is provided at a part, which is lower than a central part of the face portion, on an inner surface of the face portion to protrude toward a center of the head.

According to the golf club having the head of the aforementioned structure, the rib is provided on the rear side of the face portion. Thus, the specific strength and the specific rigidity of the lower side part of the face portion are increased, so that a lower-side region is hard to bend, and that an upper-side region can partly be deformed. Consequently, at the hitting of a ball, the face portion does not entirely bend. Accordingly, the loss of energy can be reduced to thereby enhance the repulsion of a ball. Also, the provision of the rib can facilitate the inclination of the upper-side part of the face portion around the upper vicinity of the rib. The hitting of a ball just above the part, whose inclination is increased, results in increase in the launch angle. Thus, the flying distance can be increased. Additionally, the provision of the rib on the rear surface of the face portion can enhance the flexibility of the design of the gravity center and that of inertia moment. As long as the aforementioned rib protrudes toward the center of the head, the rib can be formed integrally with the face portion. Alternatively, the rib can be formed integrally with the sole portion and the side portion.

According to the invention, a golf club is obtained, which can reduce the loss of energy at hitting of a ball thereby to increase the repulsion, and which can increase the launch angle thereby to increase the flying distance of a ball.

Further, the inventors of the present invention have focused on the following specific problem. That is, when a ball is hit at a part of the face portion, which is lower than the central position thereof, the speed of the ball at impact is high because of increase in the impact efficiency due to the shape of the roll of the face portion and also because of increase in the inertia moment in an up-down direction. Thus, a golfer makes a mistake that he feels that the ball has squarely been hit. The inventors have focused on this specific problem. Consequently, the inventors have conceived the present invention.

Meanwhile, as introduced by the aforementioned related art document, the CT-value at the face portion can be varied with parts of the face portion according to the structural features, for example, the thickness and the material of the face portion. Generally, it is considered that when the CT-value is increased, the contact time between the ball and the face portion at the hitting of the ball is lengthened to thereby suppress the ball from being squashed, and that thus, the speed of the ball is increased. The causal relationship between the CT-value and the speed of the ball is established so that as the CT-value increases, the speed of the ball increases.

However, conversely, in a case where the CT-value is too high, a time taken to restore the face portion, which has bent, is longer than a time taken to restore the ball having been squashed. Thus, the speed of the ball decreases. Although the speed of a ball depends upon the material of the ball actually, it is presumed that the speed of the ball can be increased by increasing the CT-value up to about $400\times10^{-6}$ seconds (incidentally, in consideration of ordinary materials of the face portion, it is impractical to increase the CT-value to about $400\times10^{-6}$ seconds, and therefore, it is considered that the initial speed of a ball can be increased by increasing the CT-value, in view of the material of the conventional face portion).

The structure of the enlarged conventional head has been designed so that the CT-value at the central position of the face portion is increased, and that even when a ball hitting position is off the central position of the face portion, reduction in the speed of the ball is prevented by increasing the CT-value at a peripheral position around the central position of the face portion, as disclosed by Japanese Patent Document 2. However, in the case of such a structure of the head, even when a ball is hit at a sole-side part of the face portion, the speed of the ball is not reduced. Therefore, a golfer makes the mistake, as described above.

Thus, to achieve the foregoing object, the golf club according to the invention includes a head of a hollow structure that has a face portion for hitting a ball, that has capacity which is equal to or more than 380 c.c., and that has inertia moment in the up-down direction, which is equal to or more than 2200 $g\cdot cm^2$, so that the height of the face portion which is equal to or more than 48 mm. The head features that the hollow structure includes the face portion having a region which meets the condition $CTu/Ctc\leqq0.75$ in a range within 12 mm from the central position of the face portion, where "CTc" designates a CT-value at the central position of the face portion and where "CTu" denotes a CT-value at a position lower than the central position of the face portion.

The golf club having the aforementioned head structure is set so that the CT-value (CTu) at a position lower than the central position of the face portion is lower than the CT-value (CTc) at the central position of the face portion by a predetermined rate. Thus, the speed of a ball hit by a lower-side part lower than the central position of the face portion is suppressed. Consequently, a golfer does not make a mistake that he feels that the meat of the face portion of the club head is a point lower than the central position of the face portion. That is, tendency is to make a flying distance, which is expected by a golfer when hitting a ball, coincide with an actual flying distance. The golfer does not misunderstand that a long flying distance cannot be obtained by this club.

Incidentally, in the foregoing description of the head configured to have the hollow structure, the CT-value is a value measured in conformity with a pendulum test devised by the USGA (the United States Golf Association). The aforementioned specific problems caused by enlarging the head tend to prominently occur in a case where the capacity of the head is equal to or more than 380 c.c., and where the inertia moment in the up-down direction is equal to or more than 2200 $g \cdot cm^2$. Heads of such a size are objects to which the invention is applied.

Additionally, the height of the face portion is determined according to the fact that the ball mark of a soft ball is about 24 mm in diameter and the ball mark of a hard ball is about 21 mm in a case where the speed of the head is 40 m/s. That is, in view of the fact that the maximum diameter of the ball mark of a ball hit by an ordinary golfer is about 24 mm, heads, the use of which is likely to cause a golfer to make a mistake that the golfer feels that "a ball has squarely been hit" even when a ball hitting position on the face portion is shifted from the central position of the face portion by a half the size of a ball in the up-down direction, are objects to which the invention is applied. More specifically, in a case where the height of the face portion is less than 48 mm, when a ball hitting position is shifted from the central position of the face portion by a half the size of a ball in the up-down direction, an amount of spin becomes abnormal under the influence of a boundary part of the crown portion or the sole portion. Therefore, the heads, in each of which the height of the face portion is equal or more than 48 mm, are objects to which the invention is applied. Additionally, the heads, in each of which the loft angle is within a range in which the impact efficiency problem is actualized, more specifically, in an angle range from 7° to 15°, are objects to which the invention is applied.

In the head of the aforementioned configuration, the condition, which should be met by the face portion, is the condition $CTu/Ctc \leqq 0.75$. This condition is established according to a result that the speed of the ball hit at a position lower than the central position of the face portion is highly surely less than 100% in a case where the speed of a ball hit at the central position of the face portion is assumed to be 100% in the head of the hollow structure in which the capacity of the head is equal to or more than 380 c.c., and which the inertia moment in the up-down direction is equal to or more than 2200 $g \cdot cm^2$, and in which the height of the face portion is equal or more than 48 mm.

Preferably, the face portion has a region which meets the condition $CTt/CTc \geqq 1.04$ in a range within 12 mm upwardly from the central position of the face portion, where CTt designates the CT-value at a position upper than the central position of the face portion.

That is, when a ball is hit by a part upper than the central position of the face portion, the impact efficiency of the impact between the head and a ball usually decreases, because the loft angle is increased due to the influence of the roll. Thus, the speed of the ball tends to decrease. Further, reduction in the speed of a ball hit by an upper part of the face portion is suppressed by setting the CT-value at a region upper than the central position of the face portion to be higher than the CT-value at the central position of the face portion. Consequently, the flying distance of a ball can be increased.

According to the invention, the flying distance, which is expected when hitting a ball, is made to easily coincide with an actual flying distance. Thus, a golfer hits a ball by a part of the face portion of the head, by which a longest flying distance can favorably be obtained. Consequently, a golf club enabled to increase the flying distance can be obtained.

DETAILED DESCRIPTION OF THE PREFERRED EMBODIMENTS

First Embodiment

Hereinafter, an embodiment of a golf club according to the invention is described.

Figure 1:
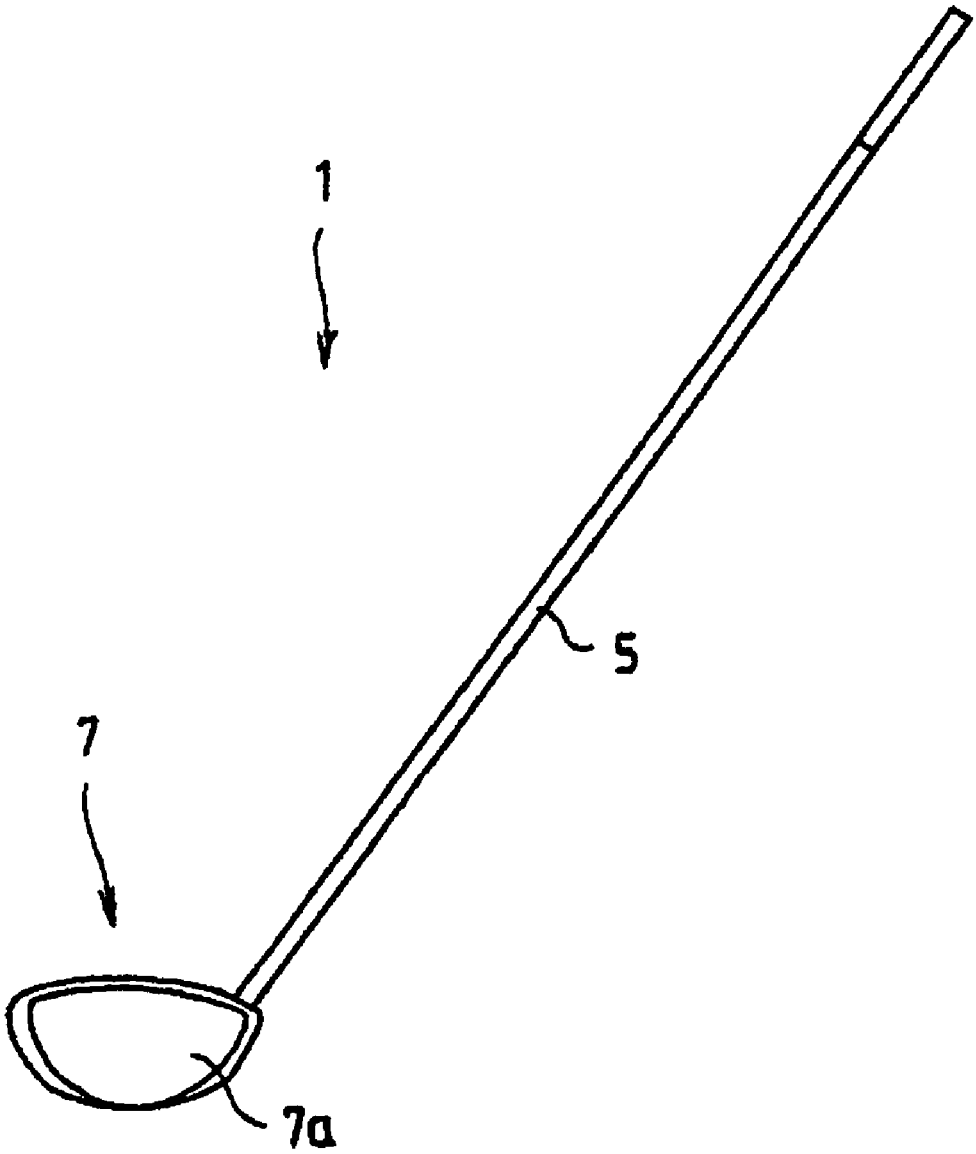
FIG. 1 is a front view illustrating a golf club, which shows a first embodiment of a golf club according to the invention.
Figure 2:
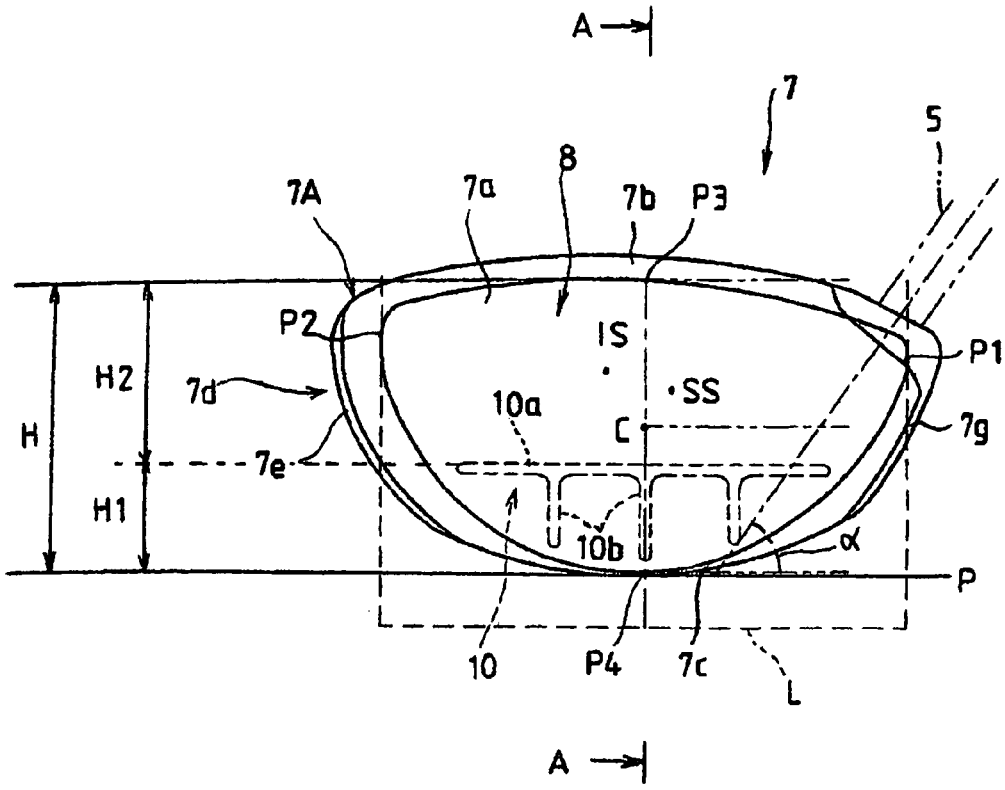
FIG. 2 is a front view of a head.
Figure 3:
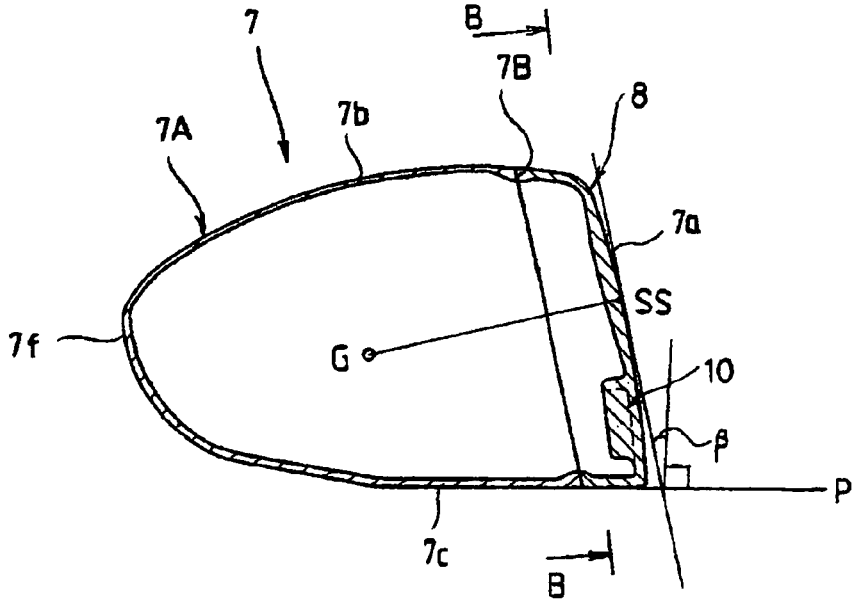
FIG. 3 is a cross-sectional view taken along line A-A shown in FIG. 2.
Figure 4:
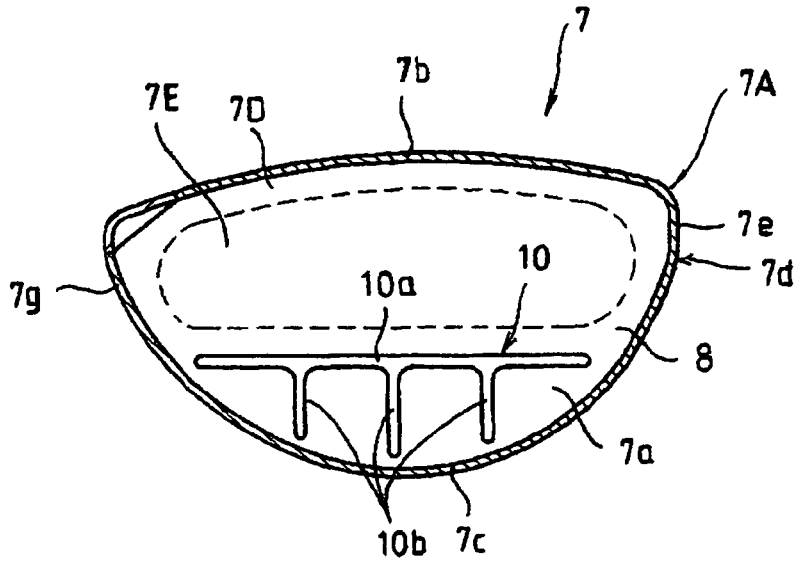
FIG. 4 is a cross-sectional view taken along line B-B shown in FIG. 3.
Figure 5:
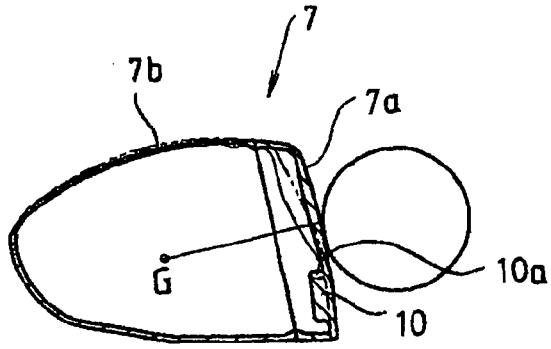
FIGS. 5A and 5B are cross-sectional views illustrating modified states of a face portion at hitting of a ball.
Figure 5:
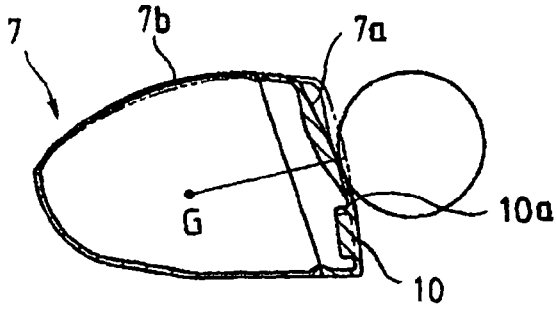

FIGS. 1 to 5B are views illustrating a first embodiment of the golf club according to the invention. FIG. 1 is a front view illustrating the golf club. FIG. 2 is a front view of a head. FIG. 3 is a cross-sectional view taken along line A-A shown in FIG. 2. FIG. 4 is a cross-sectional view taken along line B-B shown in FIG. 3. FIGS. 5A and 5B are cross-sectional views illustrating modified states of a face portion at hitting of a ball.

A golf club 1 according to the present embodiment is constituted by fixedly attaching a head 7, which is set to have a predetermined lie angle α and a predetermined loft angle β with respect to a reference horizontal plane P, to an end of a shaft 5 made of metal or FRP (Fiber-Reinforced Plastics). In this case, a head body 7A constituting the head 7 is formed into a hollow structure that has a face portion 7*a* including a ball hitting surface, and that has a crown potion 7*b* extending backwardly from the top edge of the face portion 7*a*, and a sole portion 7*c* backwardly extending from the bottom edge of the face portion 7*a*. The hollow structure further has a side portion 7*d* that extends from a toe-side edge of the face portion a heel-side thereof through a back side thereof and that connects edge parts of the crown portion 7*b* and the sole portion 7*c* to each other. In the figures, reference numerals 7*e*, 7*f*, and 7*g* designate a toe part, a back part, and a heel part of the side portion 7*d*, respectively.

A face member 8, at which a ball is actually hit, is provided in the face portion 7*a*. In this case, the face member 8 can be formed of a plate-like member that closes a front opening surrounded by the crown portion 7*b*, the sole portion 7*c* and the side portion 7*d* (i.e., the entire face portion is constituted by the face member). Alternatively, the face member can be shaped like what is called a cup, and constitute a part of each of the crown portion 7*b*, the sole portion 7*c*, and the side portion 7*d*, similarly to the present embodiment (see FIG. 3). Alternatively, the head can be formed by preliminarily forming an opening having a predetermined side in the face portion 7*a* and by then fitting a plate-like face member into this opening.

Preferably, the head body 7A other than the face member 8 provided in the face member 7*a* is formed integrally with the face portion 7*a* by casting, for example, a titanium alloy (e.g., Ti-6Al-4V, or Ti-15V-3Cr-3Sn-3Al), an iron alloy (e.g., 17-4 ph, or SUS304), or Custum450® (manufactured by Carpenter Technology Corporation). An opening 7B, to which a cup-shaped face member 8 constituting a ball hitting surface of the face portion 7*a* is fixedly attached by welding or bonding, is formed in a front-side part of the head body 7A. Apparently, the head body 7A can be constructed by preliminarily and individually forming the members (i.e., the face portion, the crown portion, the sole portion, the side portion, and an outer shell member) constituting the head body 7A and by then fixing these members by welding or molding.

Preferably, the face member 8 provided in the face portion 7*a* is integrally formed into a predetermined cup-like shape by performing press working or forging on, for example, a titanium alloy (e.g., Ti-15V-3Cr-3Sn-3Al, Ti-5Al-4V, SP700, Ti-15V-6Cr-4Al, Ti-15Mo-5Zr-3Al), an iron alloy (Custom 455 or 465 (manufactured by Carpenter Technology Corporation), 18Ni-12Co-4, or 5Mo-1, or 5Ti—Fe), or Ti-30Nb-10Ta-5Zr. The face member 8 formed in this way is fixedly attached to an end surface of the opening 7B by attaching, welding, or brazing (i.e., hard soldering). Apparently, the face portion 7*a* can be formed integrally with the head body 7A, instead of fixedly attaching the face member, which is a separate member, thereto.

Also, a shaft-fixing-attachment portion (not shown), to which an end of the shaft 5 is fixedly attached, is integrally formed in the head body 7A. In this case, the shaft is fixedly attached to the shaft-fixing-attachment portion by inserting an end portion of the shaft into an opening hole formed in the crown portion 7*b*. The shaft-fixing-attachment portion and the crown portion 7*b* may be either separated from each other or connected integrally with each other. Alternatively, the shaft-fixing-attachment portion and the crown portion 7*b* can be connected to each other by a low-rigidity member made of rubber or a synthetic resin.

A rib 10 is formed on the inner surface of the face portion 7*a*. This rib is a member protruding from the inner surface of the face portion 7*a* toward the center of the head. The rib 10 has functions of enhancing the specific rigidity and the specific strength of a specific region (i.e., a lower-side region) of the face portion having the ball hitting surface. In this case, preferably, an amount of projection of the rib is set to be within a range of 1.0 mm to 13.0 mm, because of the fact that when the amount of projection from the inner surface is too large, an increase in weight is too large and the design flexibility thereof is low, and that when the amount of projection therefrom is too small, the specific rigidity and the specific strength cannot sufficiently be enhanced. Additionally, preferably, the width of the rib is set to be within a range of 1.0 mm to 6.0 mm, for the same reason. Preferably, the thickness of the face surface provided around the rib is set to be within a range of 1.2 mm to 5.0 mm, because of the facts that in a case where the thickness thereof is too large, an increase in weight thereof is too large and the design flexibility thereof is low, and that the thickness thereof is too small, stress concentration easily occurs due to the presence of the rib.

Preferably, the rib 10 has a transverse rib 10*a* extending along a toe-heel direction and a longitudinal rib 10*b* extending along a crown-heel direction so as to be able to effectively enhance the specific rigidity and the specific strength of a lower-side region of a ball hitting surface. With the configuration of the present embodiment, the transverse rib and the longitudinal rib are formed integrally with the face member 8 of the face portion by casting or forging. As illustrated in the figure, the transverse rib and the longitudinal rib can be either formed continuously or formed separately. The number of the transverse ribs and that of the longitudinal ribs are appropriately set. Regarding the directionality of each of the transverse ribs and the longitudinal ribs, the direction of each of the transverse ribs and the longitudinal ribs may be set to be not exactly parallel or perpendicular to a reference horizontal plane P (see FIG. 13).

A position, at which the rib 10 is provided, is set to be lower than a face center C that is a central part of the face portion 7*a*. The face center C is defined to be the center between a crown-side face boundary point P3 and a sole-side face boundary point P4 on a middle perpendicular line passing through the center of a line segment having a maximum width L (i.e., the center between a heel-side face boundary point P1 and a toe-side face boundary point P2) in the toe-heel direction of the ball hitting surface. Incidentally, the face boundary points P1 to P4 are usually defined by edge parts or parts at which finishing (e.g., satin finishing, mirror finishing, blast finishing, and paint finishing) is changed. In a case where the face portion is continuously constituted by an R-curved surface, and where the face center cannot be determined according to such criteria, the position of the face center C is determined to be a position on a curved-surface whose curvature radius is less than that corresponding to R60.

The rib 10 according to the present embodiment is such that one transverse rib 10*a* extending in parallel to a reference horizontal line P is formed without being connected to the side portion of the head body in a case where the head 7 is installed at a lie angle α with respect to the reference horizontal line P, and that three longitudinal ribs 10*b* are formed at predetermined intervals to be perpendicular to the transverse rib 10*a*. Among the three longitudinal ribs 10*b*, the central longitudinal rib is formed to be longer than the longitudinal ribs formed on both sides thereof according to the shape of the face portion.

Consequently, as illustrated in FIG. 2, a part in a range H1, in which the rib 10 is formed, in a direction of height of the head is larger in the specific rigidity and the specific strength than a part in a range H2, in which the rib 10 is not formed, in the direction of the height of the head. An upper-side part of the face portion can easily bend, as compared with a lower-side part of the face portion. Also, the face portion is suppressed from entirely bending. In this case, when the range H1, in which the rib 10 is formed, in the direction of height of the head is too large, a range, in which a high initial speed of a ball at hitting of the ball can be obtained, is too narrow. Conversely, in a case where the range H1 is small, a high launch angle cannot be obtained. Thus, preferably, the height in the range H1 is set to be within a range of 0.2 H to 0.5 H where "H" designates a maximum height of the face portion 7*a*. In a case where the height of the bottom of the face surface differs from the height of the sole surface, the bottom P4 of the face surface is employed as a bottom base point for defining the height H and the range H1.

In the head of the aforementioned configuration, the head is designed so that a position IS at which the maximum resilience of the face portion is obtained (i.e., the maximum resilience point measured in conformity with the pendulum test defined by USGA (the details of the pendulum test are described in "Technical Description of the Pendulum Test" attached to "Notice to Manufactures" issued from USGA on Feb. 24, 2003)) is positioned closer to a toe-side than a sweet-spot SS (a point of intersection of the face portion 7*a* and a normal drawn thereto from the gravity center G of the head).

As a result of designing the head in this manner, a high initial speed of a ball hit by the head can be obtained while a ball spin in a hook direction due to the gear effect and a high launch angle are obtained. Thus, a large flying distance of a ball flying in a high draw trajectory can be obtained.

Additionally, preferably, as illustrated in FIG. 4, an upper region, in which the rib 10 is not formed, in the face portion is formed so that a central part of this region is formed as a thick part 7E, and that a peripheral part of this region is formed as a thin part 7D.

The face portion is formed in this way. Thus, the interaction thereof with an increase in the rigidity due to the rib of the face portion enables stabilization of the launch angle that varies with a slight shift of a ball hitting point while a high launch angle is obtained.

According to the golf club having the head 7 constituted as described above, the rib 10 is provided at the rear side of the face portion 7*a*. Thus, as illustrated in FIGS. 5A and 5B, the lower-side part of the face portion 7*a* is hard to bend. In contrast, the upper-side part of the face portion 7*a* can partly deform. Consequently, when a ball is hit, the face portion does not entirely bend. Accordingly, the loss of energy can be reduced. The repulsion can be increased. Additionally, the upper-side part of the face portion 10 can easily be inclined around the upper vicinity of the transverse rib portion 10*a*. Thus, the launch angle can be increased by increasing the inclination of the upper-side part. Consequently, the flying distance can be increased. In this case, the rigidity of the crown portion 7*b* of the head is reduced to be low, as compared with the sole-side thereof by reducing the thickness of the crown portion 7*b*, or upwardly bending the crown portion 7*b*. Thus, when a ball is hit, the upper-side part of the face portion becomes easy to bend. Consequently, the launch angle can be increased. Incidentally, the reduction in the rigidity in this case can be achieved by cutting off the crown portion 7*b* and the sole portion 7*c* from the head body 7A so that when comparing the rigidities in a face-back direction of the crown portion 7*b* and the sole portion 7*c*, the rigidity of the crown portion 7*b* is lower than the rigidity of the sole portion 7*c*.

According to the head of the aforementioned configuration, the rib 10 is provided in the face portion 7*a*. Thus, the flexibility of design of each of the gravity center and the inertia moment can be enhanced. That is, the width and the height of the rib 10, and the numbers and the installation positions of the transverse ribs and the longitudinal ribs are appropriately changed. Consequently, the design flexibility of the gravity center and the inertia moment can be increased. Also, the weight of the face portion can be decreased while the rigidity of the face portion is maintained at a high level. Additionally, the weight of the face portion can be redistributed to the head.

Second Embodiment

Figure 6:
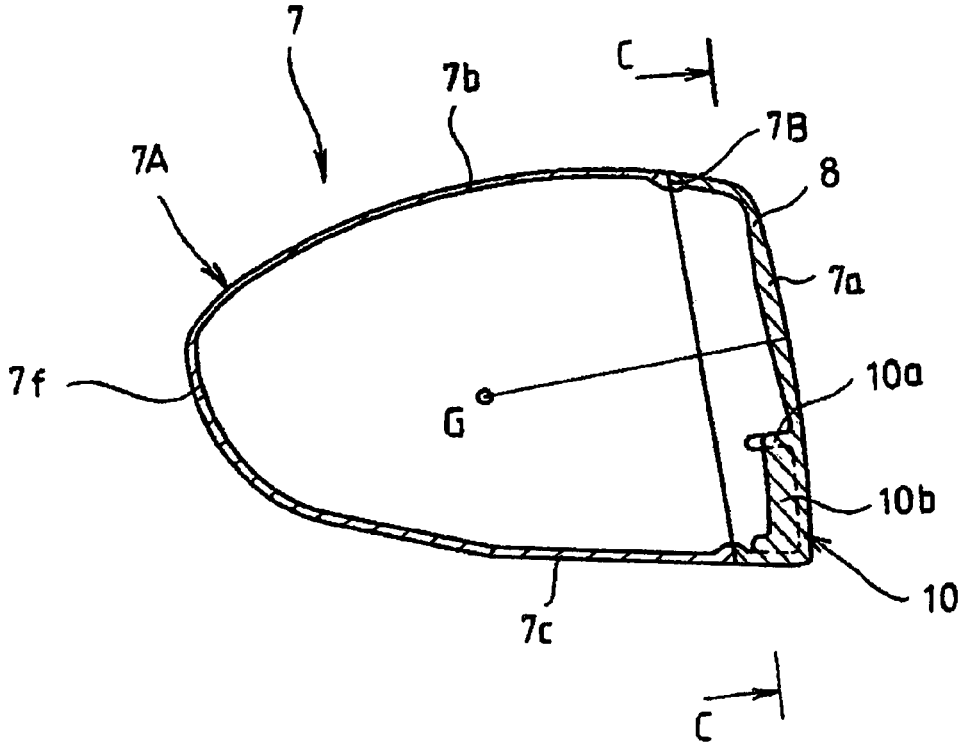
FIG. 6 is a central cross-sectional view of a head, which illustrates a second embodiment of the invention.
Figure 7:
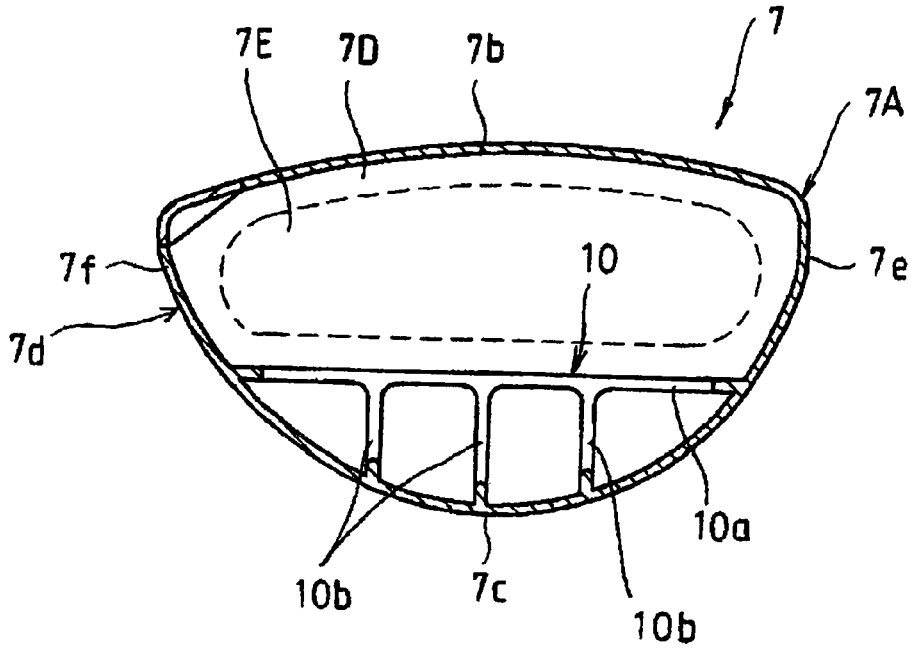
FIG. 7 is a cross-sectional view taken along line C-C shown in FIG. 6.

FIGS. 6 and 7 are views illustrating a second embodiment of the invention. FIG. 6 is a central cross-sectional view of a head. FIG. 7 is a cross-sectional view taken along line C-C shown in FIG. 6.

Similarly to the first embodiment, the second embodiment is configured so that when a face member 8 is formed into a predetermined cup-like shape, an end portion of the rib 10 to be formed integrally with the side portion and the sole portion is formed to reach the side portion (a toe part and/or a heel part in the case of the transverse rib 10*a*) and the sole portion (in the case of the longitudinal rib 10*b*). The rib 10 is formed integrally with the side portion and the sole portion.

With such a configuration, the specific rigidity and the specific strength of the lower-side part of the face portion 7*a* are further increased. When a ball is hit, the entire face portion becomes more difficult to bend. Thus, the loss of energy can effectively be suppressed. In a case where the height and the width of the rib 10 is slightly reduced, advantages similar to those of the first embodiment can be obtained. A reduced amount of weight of the rib 10 can be redistributed to the head. The flexibility of design of each of the gravity center and the inertia moment can be increased.

Apparently, in this configuration, the head can be constructed so that only one of the transverse rib portion 10*a* and the longitudinal rib portion 10*b* is made to reach the side portion or the sole portion. In the second embodiment, the height of the transverse rib portion 10*a* is higher than that of the other rib portion. Consequently, a higher launch angle can be implemented due to the effect of the rigidity of the transverse rib portion 10*a*.

Third Embodiment

Figure 8:
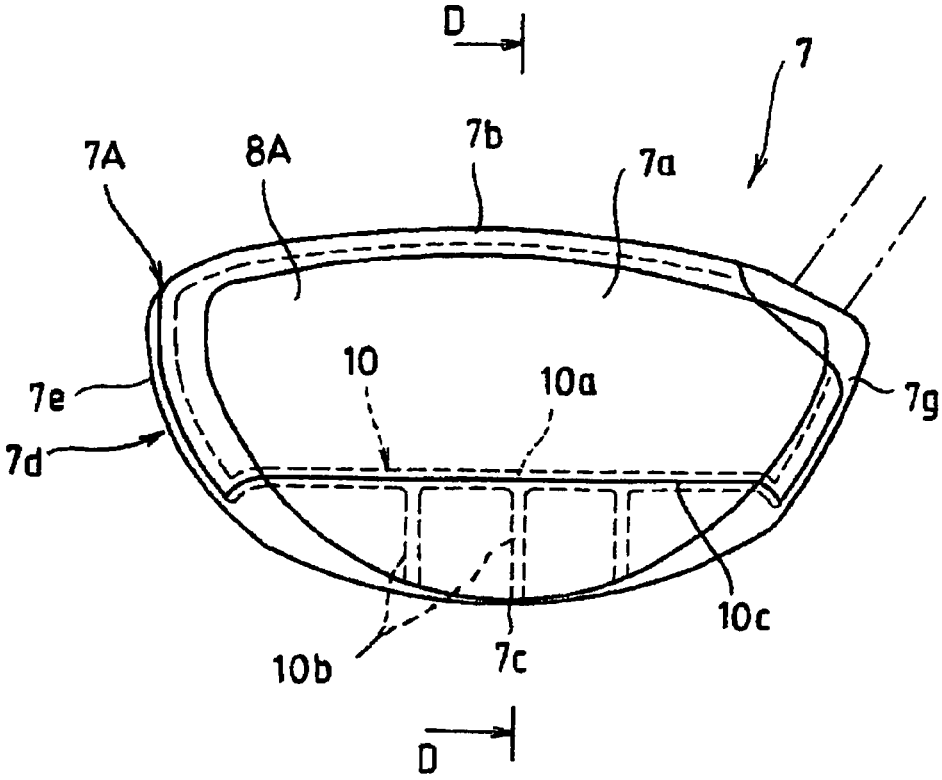
FIG. 8 is a central cross-sectional view of a head, which illustrates a third embodiment of the invention.
Figure 9:
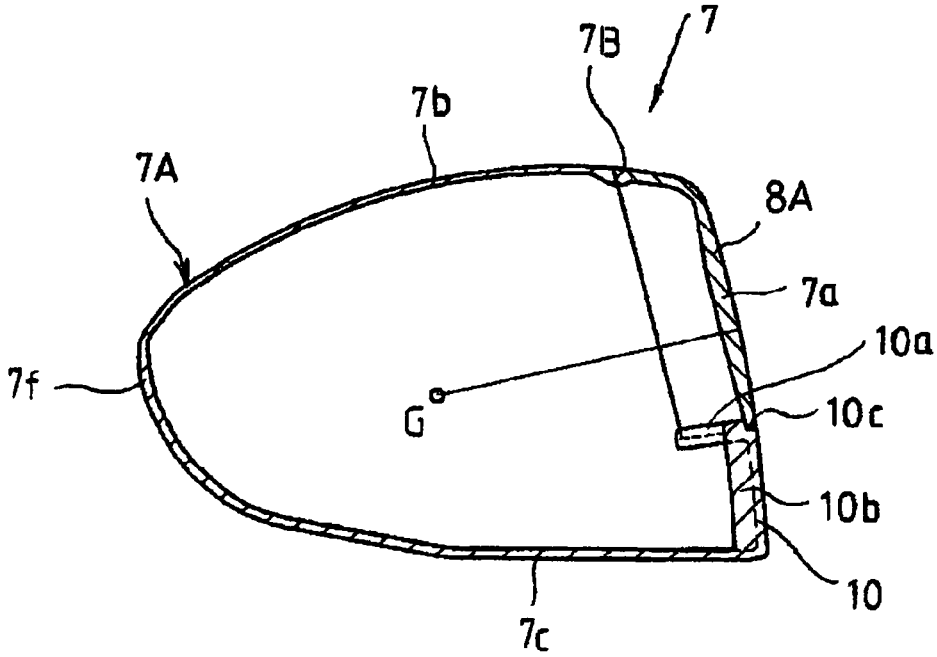
FIG. 9 is a cross-sectional view taken along line D-D shown in FIG. 8.

FIGS. 8 and 9 are views illustrating a third embodiment of the invention. FIG. 8 is a central cross-sectional view of a head. FIG. 9 is a cross-sectional view taken along line D-D shown in FIG. 8.

According to the present embodiment, a lower-side part (i.e., a rib formation region) of a face portion 7*a* is formed integrally with a head body 7A. Also, a transverse rib 10*a* and a longitudinal rib 10*b* are formed integrally with each other. Similarly to the aforementioned first and second embodiments, a face member 8A is formed by being backwardly bent so as to constitute a part of a crown portion, a toe portion and a heel portion. However, a sole-side edge part of the face member 8A is connected and fixed to a step-like portion 10*c* formed at the front end side of the transverse rib 10*a*, without being bent-formed. That is, the transverse rib 10*a* is placed at a connection portion serving as a lower edge of the face member 8A. Consequently, the strength of the connection portion is increased.

In the aforementioned configuration, a lower-side region of the face portion 7*a* is formed integrally with the head body. This region is formed integrally also with the rib 10. Thus, the specific rigidity and the specific strength of the lower-side region of the face portion 7*a* are further increased. The loss of energy at hitting of a ball can be further reduced. Consequently, the repulsion of a ball can be enhanced. In the case of the third embodiment, it is useful to form the head body and the lower-side region of the face portion 7*a* by lost-wax casting. Thus, a high-quality head can be manufactured at low cost.

Fourth Embodiment

Figure 10:
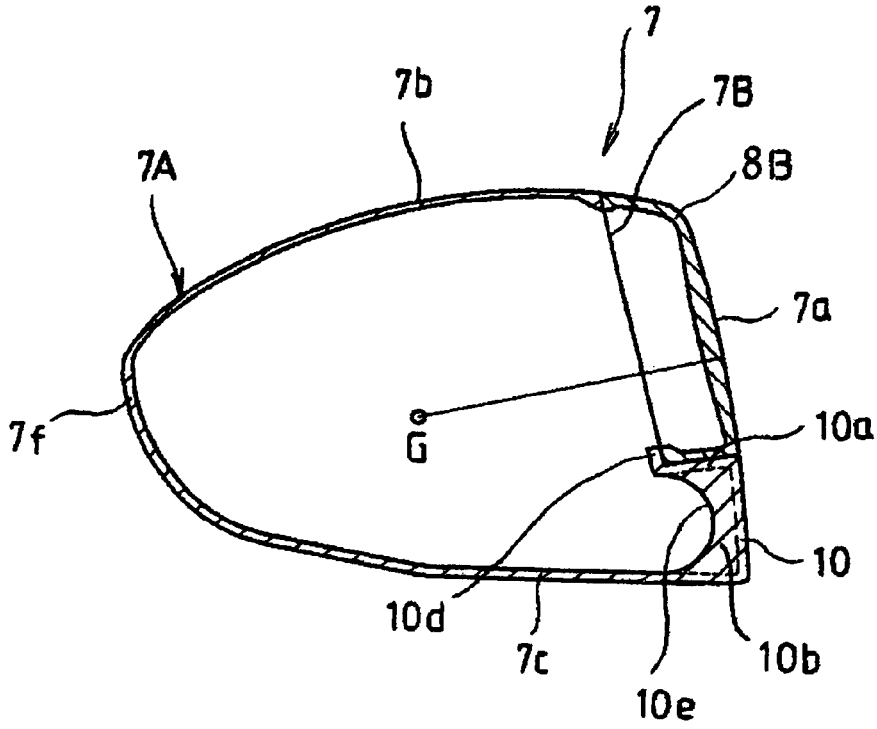
FIG. 10 is a central cross-sectional view of a head, which illustrates a fourth embodiment of the invention.

FIG. 10 is a central cross-sectional view of a head, which illustrates a fourth embodiment of the invention.

According to the fourth embodiment, a projection portion 10*d* serving as a connection portion is formed at an end of an inner extension portion of the transverse rib 10*a* of the third embodiment to upwardly protrude therefrom. A position, at which the projection portion 10*d* is formed, is set to be flush with a front-side opening in the crown portion 7*b* and the side portion 7*d* of the head body 7A. Thus, a face member 8B can be constituted like a cup, similarly to the first embodiment. Consequently, a connection surface of the face member 8B, which is connected to the head body 7A, can be formed as one surface to be in surface contact with an opening part 7B. Accordingly, assembling accuracy can be enhanced. The projection portion 10*d* is configured to support the face member 8B against a force of hitting a ball. Thus, the strength of the head is stabilized. When the head is manufactured, a slight gap is produced between the projection portion 10*d* and the face member 8B. Therefore, preferably, this gap is filled by brazing or welding. Consequently, the strength and the CT-value can be further stabilized.

As shown in the figure illustrating the fourth embodiment, a curved lightening portion 10*e* is formed in the rib 10 (i.e., longitudinal rib 10*b*). Thus, the position of the gravity center and the inertial moment can be adjusted. Apparently, such adjustment can be performed by, for example, forming a hole in the rib. Preferably, the sole 7*c* and the longitudinal rib portion 10*b* are smoothly connected to each other, as illustrated in FIG. 10. In a case where the head is provided with a plurality of the longitudinal rib portions 10*b*, preferably, the positions of the sole-side end portions respectively corresponding thereto differ from one another in distance from a leading edge. Consequently, the strength of the head is stabilized.

Fifth Embodiment

Figure 11:
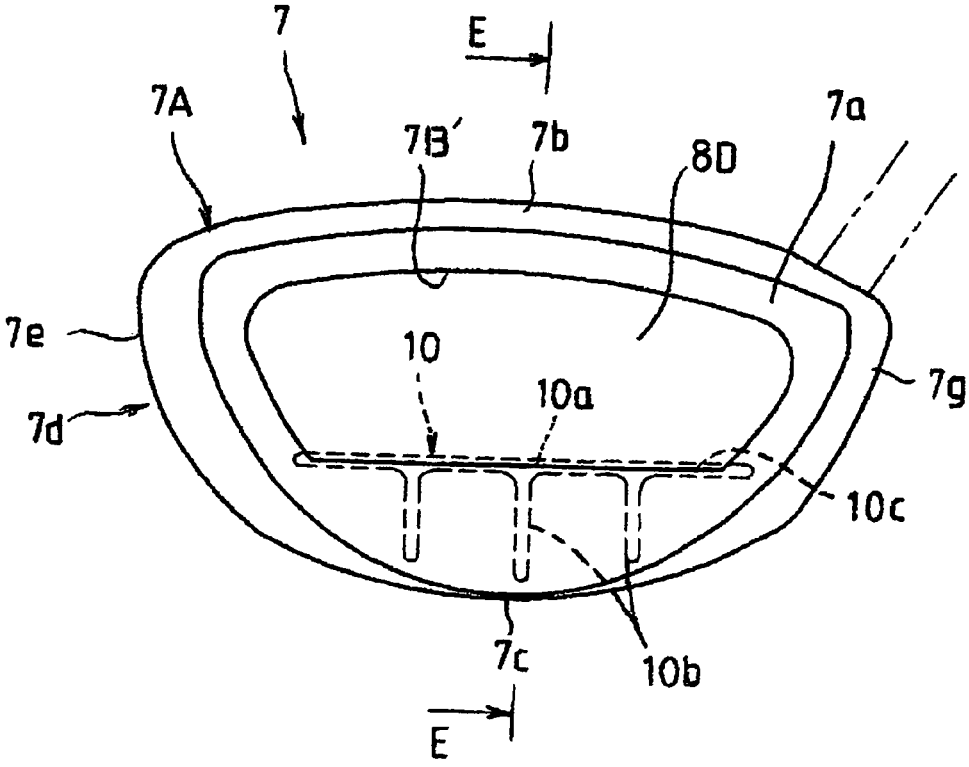
FIG. 11 is a central cross-sectional view of a head, which illustrates a fifth embodiment of the invention.
Figure 12:
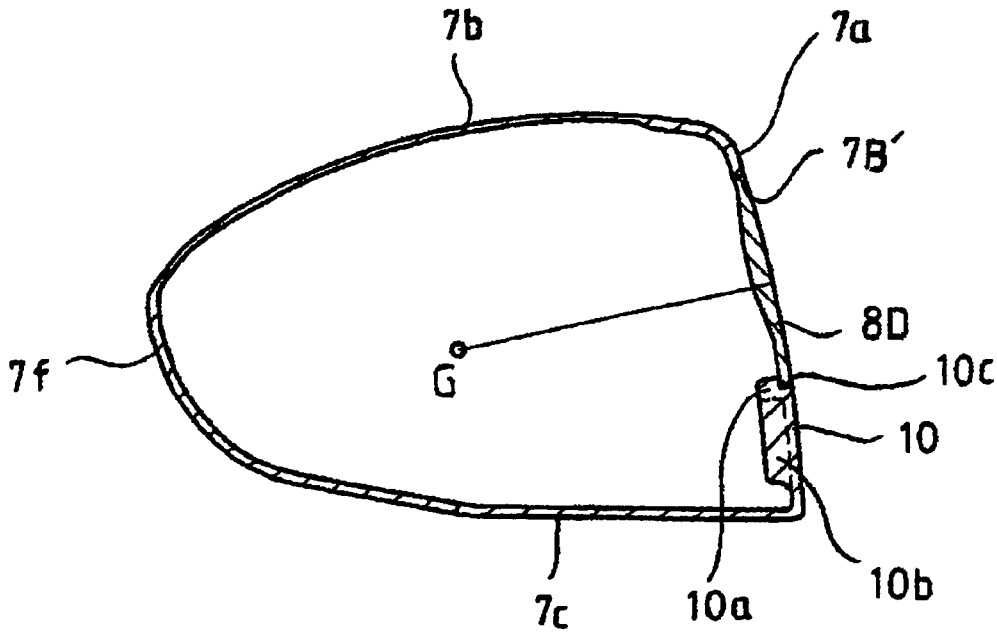
FIG. 12 is a cross-sectional view taken along line E-E shown in FIG. 11.

FIGS. 11 and 12 are views illustrating a fifth embodiment of the invention. FIG. 11 is a central cross-sectional view of a head. FIG. 12 is a cross-sectional view taken along line E-E shown in FIG. 11.

In the fifth embodiment, the peripheral portions (i.e., the crown portion, the side portion, and the rib formation region) of a face portion 7*a* are formed integrally with a head body 7A. An opening 7B' into which a plate-like face member 8D formed by forging is fit, is formed in the face portion 7*a*.

With such a configuration, options for selecting materials of the face member are broaden. Also, when a ball is hit, a bent part of the face portion is reduced. Thus, the loss of energy is further reduced. Consequently, the repulsion of a ball can be enhanced.

Preferably, in the present embodiment, the peripheral part of the face member 8D is formed thin.

Sixth Embodiment

Figure 13:
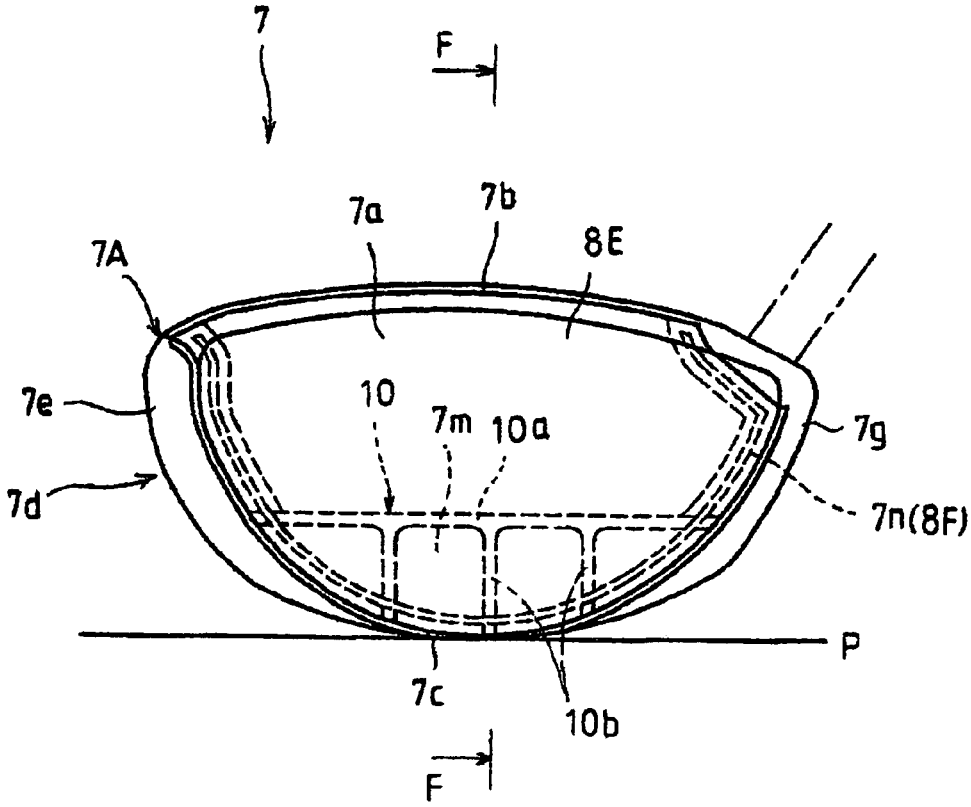
FIG. 13 is a central cross-sectional view of a head, which illustrates a sixth embodiment of the invention.
Figure 14:
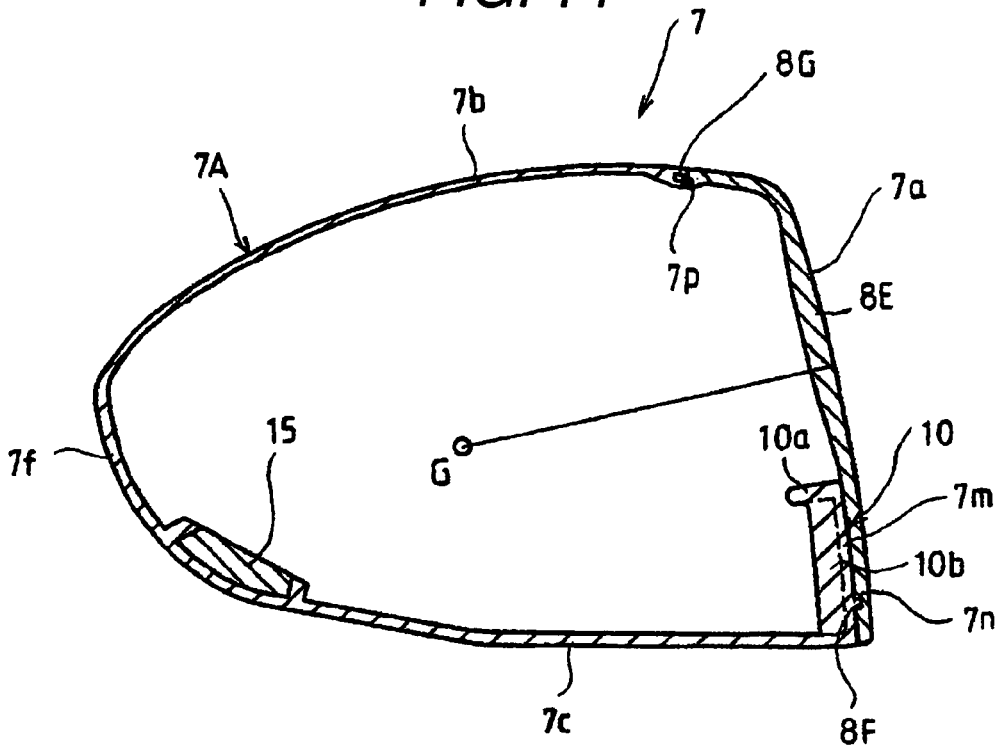
FIG. 14 is a cross-sectional view taken along line F-F shown in FIG. 13.

FIGS. 13 and 14 are views illustrating a sixth embodiment of the invention. FIG. 13 is a central cross-sectional view of a head. FIG. 14 is a cross-sectional view taken along line F-F shown in FIG. 13.

In the present embodiment, a front-end side part of a sole portion 7*c* constituting a head body 7A is curved in a substantially perpendicular direction. The sole portion 7*c* is formed integrally with a face-member-fixing-attachment portion 7*m* to which a face member 8E is fixedly attached. As illustrated in these figures, a central part of the face-member-fixing-attachment portion 7*m* rises up to the position of the transverse rib 10*a*. A toe-side part and a heel-side part of the face-member-fixing-attachment portion 7*m* rise up to the region of the crown portion. The rib 10 having the transverse rib 10*a* and the longitudinal rib portion 10*b* is provided on the rear surface of the face-member-fixing-attachment portion 7*m* formed integrally with the sole portion 7*c*. Thus, the rib 10 can be formed integrally with the head body 7A (i.e., the sole portion 7*c*) other than the face portion.

The rear surface of the face member 8E is closely attached to the front surface of the face-member-fixing-attachment portion 7*m*. Consequently, the lower-side region of the face member 8E is overlapped with the head body 7A. In this case, the face member 8E and the head body 7A are fixed to each other by brazing or bonding. Preferably, a concavo-convex fitting structure is employed so as to increase the bonding strength therebetween. More specifically, a groove portion 8F is formed along the periphery of the rear surface side of the face portion 8E. A projection portion 7*n* to be fit into the groove portion 8F is formed integrally with the face-member-fixing-attachment portion 7*n*. The groove portion 8F and the projection portion 7*n* are fit to each other and are brazed to each other. Thus, the face member 8E is fixedly attached to the face-member-fixing-attachment portion 7*n*.

The top edge of the face member 8E is backwardly bent-formed so as to constitute a part of the crown portion. An end surface of the face member 8E is connected to the crown portion 7*b*. In this case, the face member 8E and the crown portion 7*b* are fixed to each other by brazing or bonding. However, preferably, a concavo-convex fitting structure is employed so as to increase the bonding strength therebetween. More preferably, a projection portion 8G is formed along an end surface of the face portion 8E. Also, a groove portion 7*p*, into which the projection portion 8G is fit, is preliminarily formed integrally with a front end part of the crown portion 7*b*. Then, the projection portion 8G and the groove portion 7*p* are fit to each other and are then brazed to each other. Consequently, the face member 8E is fixedly attached to the crown portion 7*b*.

With the aforementioned configuration, advantages similar to those of the aforementioned embodiments can be obtained by forming the rib. Because the face member 8E is overlapped with the head body (i.e., the sole portion 7*c*), a large bonding region (i.e., a connection region) can be set on the lower-side region of the face portion 7*a*. Thus, the bonding strength can be increased by the concavo-convex fitting structure. Consequently, options for selecting materials can be broaden. That is, because the bonding strength can be increased, different kinds of materials (e.g., different kinds of metal) can be used. Also, design flexibility can be enhanced.

More specifically, a high-specific-strength titanium alloy (e.g., Ti-15V-3Cr-3Sn-3Al) is used in a part (i.e., the face member 8E) in which modification of the face portion is important. Thus, a small specific-gravity material, for example, a magnesium alloy, can be used in the head body 7A. Consequently, the entire face portion 7*a*, which is other than the upper region thereof, is covered with a magnesium alloy. Accordingly, the weight of the entire head can be reduced. In this case, the magnesium alloy is lower in specific gravity than the titanium alloy. Parts each of which is made of a large specific gravity material (e.g., a tungsten alloy) can be firmly fixed to various positions in the head body as balancers 15 by brazing, bonding, welding, or caulking. Thus, the flexibility of design of a gravity center can be increased. That is, the adjustment of the position of the gravity center is facilitated. Consequently, a golfer can easily hit a ball which flies in a high trajectory. Also, the ease of hitting a ball can be enhanced.

Additionally, a magnesium alloy is provided in lower regions of the crown portion, the side portion, the sole portion, and the face portion. Thus, the attenuation performance of the head can be enhanced. Consequently, a stable ball-hitting-feeling can be obtained. Especially, even in a case where a maximum thickness of a face member made of a titanium alloy is set to be equal to or less than 3.0 mm, a ball hitting sound can effectively be suppressed.

In the aforementioned configuration, it is sufficient that the face-member-fixing-attachment portion 7*m*, in which the rib 10 is formed integrally with the head body. The face-member-fixing-attachment portion 7*m* can be formed partly integrally with the toe portion or the heel portion.

Seventh Embodiment

Figure 15:
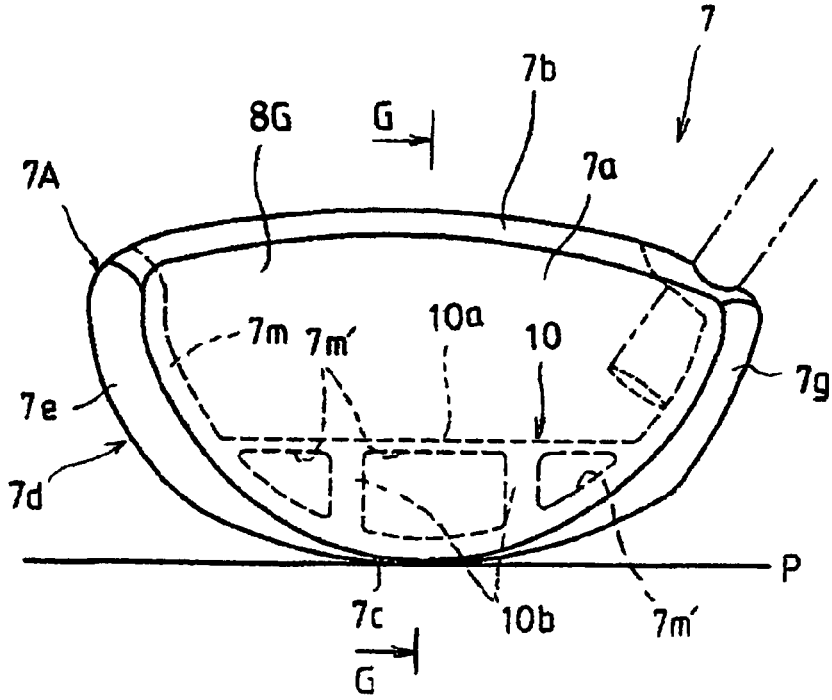
FIG. 15 is a central cross-sectional view of a head, which illustrates a seventh embodiment of the invention.
Figure 16:
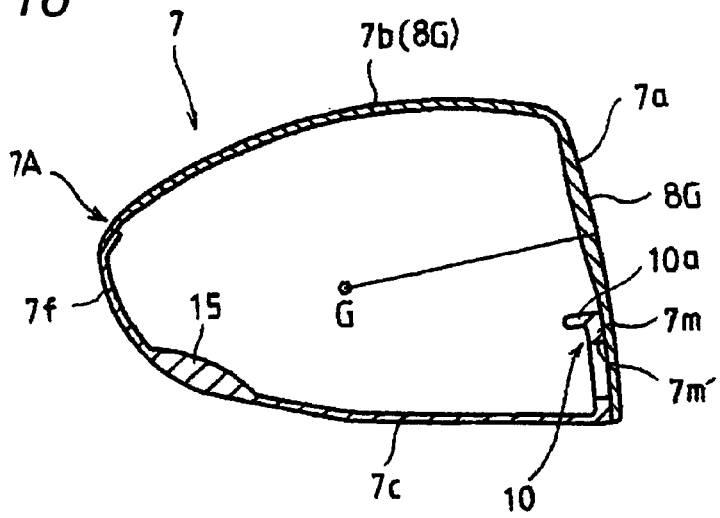
FIG. 16 is a cross-sectional view taken along line G-G shown in FIG. 15.

FIGS. 15 and 16 are views illustrating a seventh embodiment of the invention. FIG. 15 is a central cross-sectional view of a head. FIG. 16 is a cross-sectional view taken along line G-G shown in FIG. 15.

In the seventh embodiment, a gap portion 7*m*', to which the rear surface of the face member 8G is not fixedly attached, is formed in the face-member-fixing-attachment portion 7*m* having the rib 10 of the sixth embodiment. Thus, the weight of the face can be decreased by forming the gap portion 7*m*'. Consequently, the target performance of the head can be obtained. Apparently, the shape of the gap portion 7*m*' can appropriately be modified. Alternatively, the head can be configured so that a partly thin part is formed therein.

In the present embodiment, the face member 8G is formed of Carbon Fiber Reinforced Plastics (CFRP) integrally with the crown portion 7*b*. The weight of a region from the bottom to the top of the face portion and to the back portion of the head body 7A is reduced. That is, the face member 8G is fixedly attached to the face-member-fixing-attachment portion 7*m* in the lower-side region of the face portion by bonding or the like. Also, the face member 8G is over lapped with and is fixedly attached to the top part of the back portion 7*f* at a rear end of the crown portion by bonding or the like. Apparently, when both the face member 8G and the crown portion are fixedly attached to each other, a concavo-convex fitting structure can be employed, as described above.

According to the present embodiment, the face portion and the crown portion are formed integrally with each other by carbon fiber reinforced plastics. Consequently, the thickness, and the elastic modulus and the fibrous direction of carbon fiber reinforced plastics can appropriately be selected. Consequently, a flexural rigidity (EI) and strength can optionally be designed. The specific strength and the specific rigidity of the carbon fiber reinforced plastics are high. Also, no connection portion is provided in the region extending from the bottom to the top of the face portion and to the back portion. Consequently, the present embodiment can simultaneously meet the conditions that "the gravity center is low", that "the gravity center is apart from the face surface", that "the face is flexible", and that the "face is easily inclined due to the flexibility of the crown portion". Accordingly, regarding a hit ball, a high launch angle, a low amount of spin, and a high initial speed thereof can be obtained. The flying distance of a ball can be obtained. Also, a soft ball-hitting feeling can be obtained.

In the aforementioned configuration, the components (i.e., the sole portion and the side portion) other than the face portion can be constituted by various materials. For example, a titanium alloy (e.g., Ti-6Al-4V), a magnesium alloy, an aluminum alloy, stainless steel, and a stainless steel alloy can be used as the materials of the components. Additionally, the material of the face portion formed integrally with the crown portion can appropriately be changed to, for example, a titanium alloy.

In the foregoing description, the embodiments of the invention have been described. It is sufficient for the golf club according to the invention that the rib 10 for increasing the rigidity of the lower-side region is provided on a rear-side part lower the face center C of the face portion 7*a*. The shape of the rib can appropriately be changed.

Figure 17A:
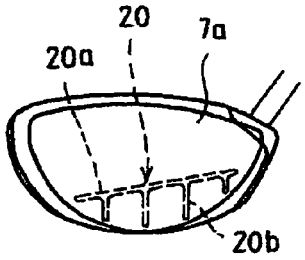
FIGS. 17A to 17F are views illustrating modifications of the shape of a rib.

For example, a rib 20 illustrated in FIG. 17A is such that when one transverse rib 20*a* and four longitudinal ribs 20*b* are provided, the transverse rib 20*a* is formed to ascend from a toe-side toward a heel-side. In a case where the rib 20 has such a shape, when a ball is hit by mistake at a toe-side part of the head, the trajectory of a golf ball can be stabilized without increasing the launch angle. As illustrated in FIG. 17D, the transverse rib 20*a* can be formed to gradually ascend by being curved.

Figure 17B:
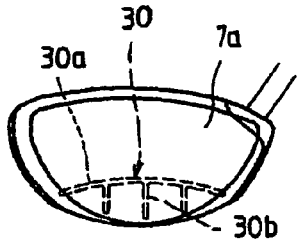

A rib 30 illustrated in FIG. 17B is such that when one transverse rib 30*a* and three longitudinal ribs 30*b* are provided, the transverse rib 30*a* is formed into a curved shape, in which a middle part is upwardly protruded, so as to broaden toe-side and heel-side ball-hitting-surfaces. In a case where the rib 30 has such a shape, when a ball is hit by mistake at a toe-side part and a heel-side part of the head, the trajectory of a golf ball can be stabilized without increasing the launch angle.

Figure 17C:
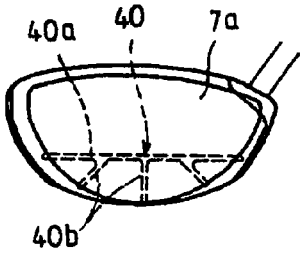
Figure 17D:
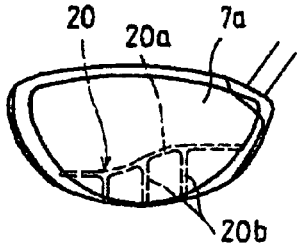
Figure 17E:
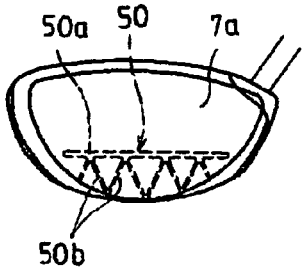
Figure 17F:
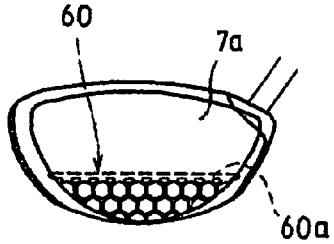

In a case where the head is provided with a plurality of longitudinal rib portions, the longitudinal ribs are not necessarily parallel to one another. For example, as illustrated in FIG. 17C, a rib 40 can be constructed by inclining a plurality of longitudinal rib portions 40*b* to one another and by connecting the plurality of longitudinal rib portions 40*b* to a transverse rib portion 40*a*. Alternatively, as illustrated in FIG. 17E, a rib 50 can be constructed by forming a plurality of longitudinal rib portions 50*b* in a zigzag manner with respect to a transverse rib portion 50*a*. Alternatively, as illustrated in FIG. 17F, a rib 60 can be constructed by forming a transverse rib portion 60*a* extending horizontally and also forming many transverse and longitudinal rib portions like a lattice under the transverse rib 60*a*. In this case, the cross-sectional shape of a concave part, in which the rib portions are formed like a lattice, can be a circular, and an oval, in addition to a polygonal shape as illustrated in FIG. 17F.

The specific strength and the specific rigidity of the lower-side region of the face portion 7*a* can appropriately be changed by modifying the shape of the rib. Additionally, the rib can be formed integrally with the rear surface of the face portion. Alternatively, the rib can be formed integrally with the sole portion and the side portion.

Eighth Embodiment

Figure 18:
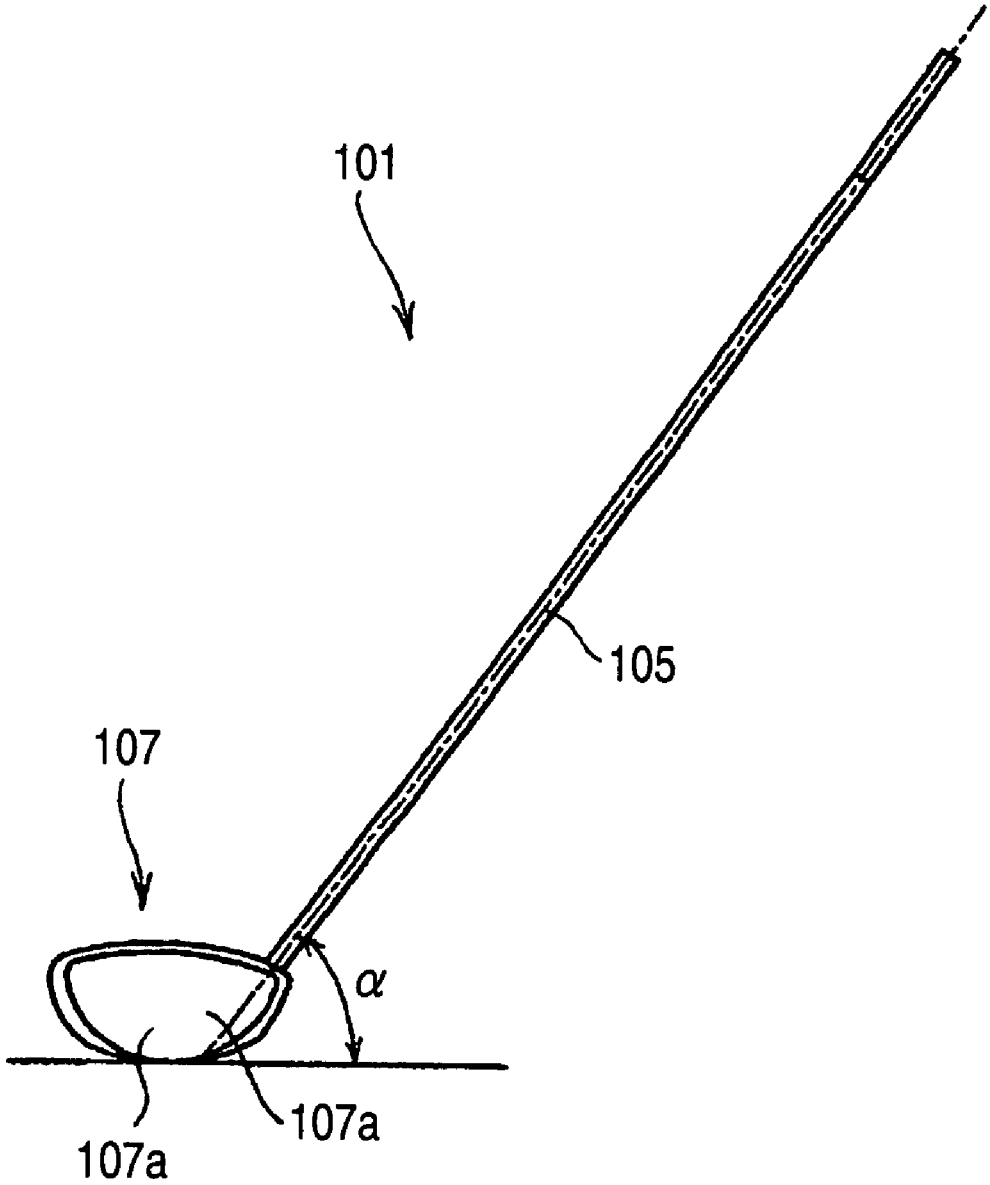
FIG. 18 is a front view of a golf club, which illustrates an eighth embodiment of a golf club according to the invention.
Figure 19:
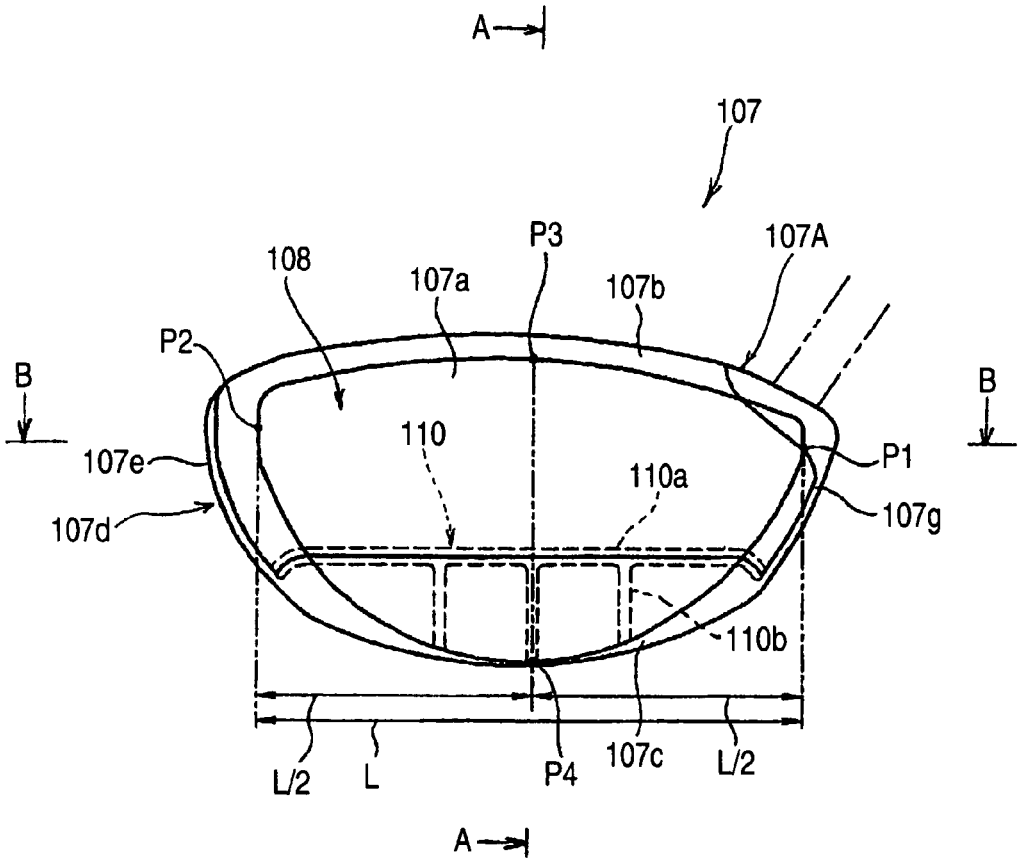
FIG. 19 is a front view of a head.
Figure 20:
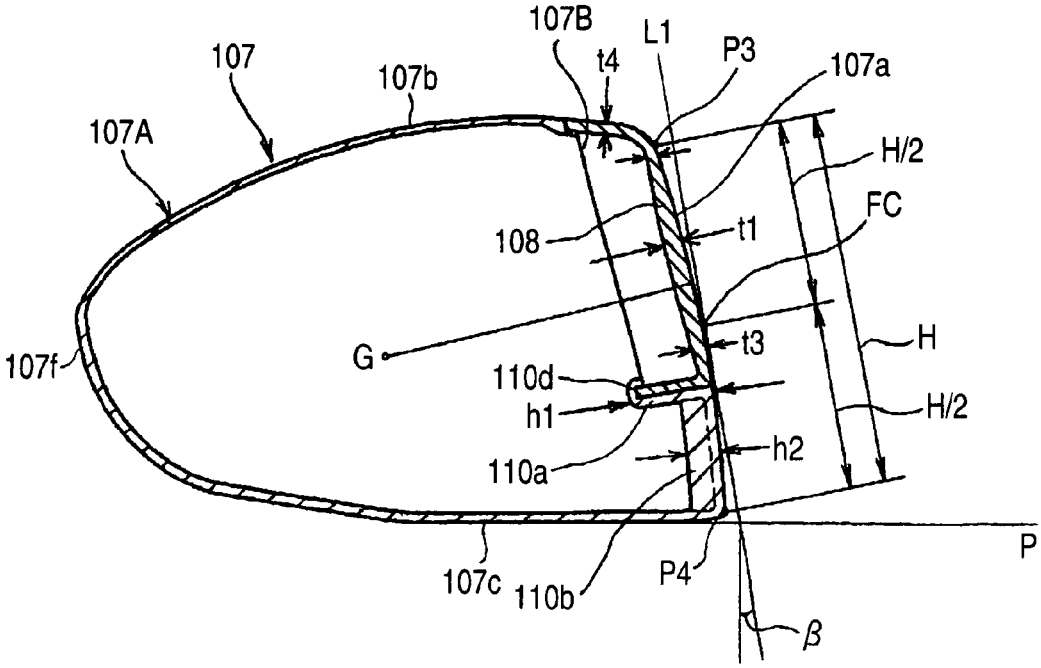
FIG. 20 is a cross-sectional view taken along line A-A shown in FIG. 19.
Figure 21:
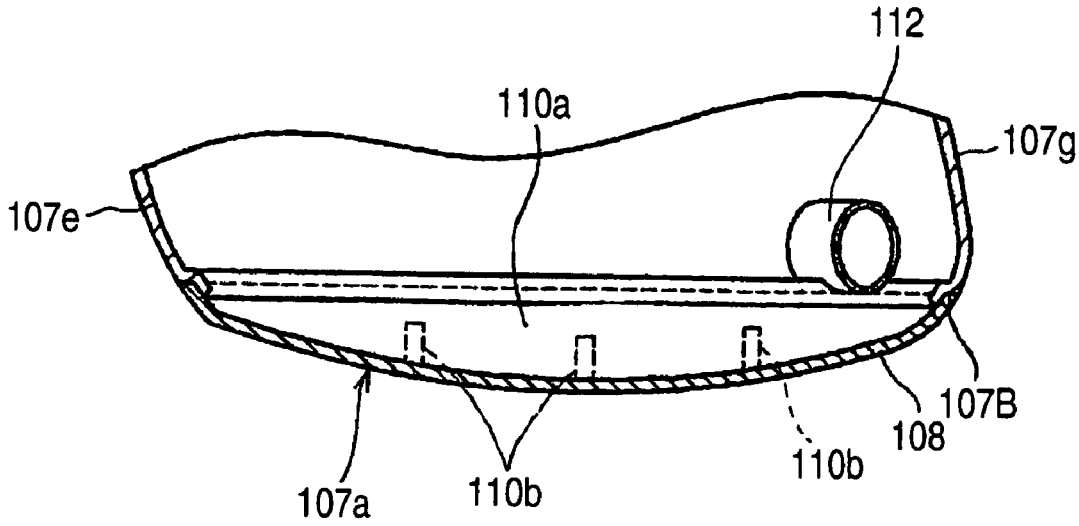
FIG. 21 is a cross-sectional view taken along line B-B shown in FIG. 19.

FIGS. 18 to 21 are views illustrating an eighth embodiment of a golf club according to the invention. FIG. 18 is a front view of the golf club. FIG. 19 is a front view of a head. FIG. 20 is a cross-sectional view taken along line A-A shown in FIG. 19. FIG. 21 is a cross-sectional view taken along line B-B shown in FIG. 19.

A golf club 101 according to the present embodiment is constituted by fixedly attaching a head 107, which is set to have a predetermined lie angle α and a predetermined loft angle β with respect to a reference horizontal plane P, to an end of a shaft 105 made of metal or FRP. In this case, a head body 107A constituting the head 107 is formed into a hollow structure that has a face portion 107*a* including a ball hitting surface, and that has a crown potion 107*b* extending backwardly from the top edge of the face portion 107*a*, and a sole portion 107*c* backwardly extending from the bottom edge of the face portion 107*a*. The hollow structure further has a side portion 107*d* that extends from a toe-side edge of the face portion a heel-side thereof through a back side thereof and that connects edge parts of the crown portion 107*b* and the sole portion 107*c* to each other. In the figures, reference numerals 107*e*, 107*f*, and 107*g* designate a toe part, a back part, and a heel part of the side portion 107*d*, respectively.

As described above, according to the invention, the face portion having a region is configured to meet the condition CTu/Ctc≦0.75 in a range within 12 mm downwardly from the central position (FC) of the face portion, where "CTc" designates a CT-value at the central position (FC) of the face portion and where "CTu" denotes a CT-value at a position lower than the central position (FC) of the face portion 107. That is, such a condition can be met by constituting the head so that, for example, the region lower than the central position of the face portion 107*a* is harder to bend, as compared with the central part of the face portion 107*a*. According to the present embodiment, a rib 110 having a predetermined shape is provided at the sole-side part of the rear of the face portion 107*a*, as will be described later. Consequently, the specific strength and the specific rigidity of the lower-side part of the face portion 107*a* are enhanced. The lower-side region of the face portion 107*a* is configured to be hard to bend. Also, the upper-side region of the face portion 107*a* can partly be deformed.

Due to such a structure of the face portion 107*a*, the face portion does not entirely bend when hitting a ball. The lower-side region becomes difficult to bend. Thus, the CT-value at the lower-side part of the face portion 107*a* can be set to be small, as compared with that at the central position (FC) of the face portion 107*a*. Accordingly, the face portion 107*a* can satisfy the condition CTu/Ctc≦0.75.

Hereinafter, the practical configuration of the head is described.

A face member 108, at which a ball is actually hit, is provided in the face portion 107*a*. As will be described later, the face member 108 is formed like a cup. The face member 108 constitutes a front-side part of each of the crown portion 107*b* and the side portion 107*d*.

Preferably, the head body 107A other than the face member 108 provided in the face portion 107*a* is integrally formed by casting a titanium alloy (Ti-6Al-4V, Ti-15V-3Cr-3Sn-3Al), an aluminum alloy, or a magnesium alloy. An opening 107B, to which the cup-shaped face member 108 constituting a ball hitting surface of the face portion 107*a* is fixedly attached by welding, brazing, or bonding, is formed in a front-side portion of the head body 107A. Apparently, the members (i.e., the face portion, the crown portion, the sole portion, the side portion, and the outer shell member) constituting the head body 107A can be preliminarily and individually formed and can be then fixed to one another by welding or bonding.

The head body 107A is formed integrally with a part of the face portion 107, more specifically, substantially (⅓) of the lower-side part of the face portion upwardly from the sole portion 107*c*. That is, the front end part of the sole portion 107*c* of the head body 107A is upwardly bent to constitute substantially (⅓) of the lower-side part of the face portion. The top part of the sole portion 107*c* is further bent toward the center of the head body. Thus, a horizontal rib (i.e., the transverse rib) 110*a*, which is a part of the rib 110 constituting means for lowering the CT-value, as compared with the CT-value at the central position of the face portion, is formed.

A projection portion 110*d* serving as a connection portion is formed at an end of an inner extension portion of the horizontal rib 110*a* to upwardly protrude therefrom. A position, at which the projection portion 110*d* is formed, is set is set to be flush with a front-side opening in the crown portion 107*b* and the side portion 107*d* of the head body 7A. Consequently, an opening 107B for attaching the face member 108 is formed. Thus, the face member 108 is formed into what is called a cup-shape. The face member 108 is fixedly attached to the opening 107B so that the bent end surface thereof is in surface contact with the opening 107B as a connection surface.

Preferably, the face member 108 provided in the face portion 107*a* is integrally formed into a predetermined cup-like shape by press-working or casing, for example, a titanium alloy (Ti-15V-3Cr-3Sn-3Al, Ti-6Al-4V, Sp700, Ti-15V-6Cr-4Al, Ti-15Mo-5ZZr, -3Al, and T-30Nb-10Ta-5Zr) or the like. The formed face member 108 is fixedly attached to an end surface of the opening 107B by bonding, welding, brazing (i.e., hard soldering). Apparently, the face portion 107*a* can be formed integrally with the head body 107A, without fixedly attaching the face member 108 thereto serving as a separate member. Alternatively, a rib can be formed on the rear surface of the face member 108 serving as a separate member constituting the face portion.

A shaft-fixing-attachment portion 112 for fixedly attaching an end of the shaft 105 is integrally formed in the head body 107. In this case, the shaft 105 is fixedly attached to the shaft-fixing-attachment portion 112 by inserting an end portion of the shaft through an opening hole formed in the crown portion 107*b*.

In the lower-side region of the aforementioned face portion, the rib 110 serving as means for lowering the CT-value has a plurality of vertical ribs (i.e., longitudinal ribs) 110*b* provided on the rear surface of the face portion 17*a* under the horizontal rib 110*a*. The vertical ribs 110*b* are formed integrally with the head body 107A constituting a part of the face portion. The vertical ribs 110*b* are formed at three places at predetermined intervals so as to be integral with the horizontal rib 110*a*. As illustrated in FIG. 21, the heights, the widths and the number of the ribs can be reduced by connecting the shaft-fixing-attachment portion 112 and the horizontal rib 110*a* to each other (preferably, to be integral with each other). Consequently, the weight of each of the ribs can be reduced.

Such ribs 110 (i.e., the horizontal rib 110*a* and the vertical ribs 10*b*) are members protruding from the inner surface of the face portion 107*a* toward the center of the head. The ribs 110 have a function of enhancing the specific rigidity and the specific strength of a specific region (i.e., a lower-side region) of the face portion having the ball hitting surface. In this case, when an amount of projection (i.e., a height) of each of the ribs 110 is too large, an increase in the weight is too large, so that the design flexibility thereof is low. Conversely, in a case where an amount of projection of each of the ribs 110 is too small, the specific rigidity and the specific strength can sufficiently be increased. Thus, preferably, the amount of projection from the inner surface (i.e., the height H1 of the rib 110*a* and that h2 of each of the ribs 110*b*) is set to be within a range from 1.0 mm to 13.0 mm. Preferably, the width (or thickness) of the rib is set to be within a range from 1.0 mm to 5.0 mm, for the same reason. It is more preferably for achieving the intended relationship between the CT-values that the relationship between the sectional area of the horizontal rib 10 and that of the vertical rib 110*b* is set so that the sectional area of the horizontal rib is larger than the sectional area of each of the vertical ribs. Consequently, the adjustment of the CT-values in the up-down direction can efficiently be achieved.

The thickness of the aforementioned face member 108 is determined according to the relationship thereof with the CT-value at the region in which the rib 110 is formed. In a case where the thickness of the entire rib is too thick, an increase in the weight thereof is too large, so that the design flexibility is low. Therefore, preferably, the thickness of the face member 108 is set to be with in a range from 1.1 mm to 3.2 mm. Incidentally, to set the CT-value at the central position (FC) of the face portion 7*a* at a high value, according to the present embodiment, the thickness t1 of a central region of the cup-shaped face member 108 is relatively thick. Also, the thickness t2 of the top region of the face member 108, the thickness t3 of the bottom region thereof, and the thickness t4 of a region thereof, which is formed integrally with the crown portion, are thinner than the thickness t1. Thus, the face member 108 has a structure in which the central region thereof is easy to bend. More particularly, the thickness t1 is preferable in a range from 2.2 mm to 2.8 mm. The thickness t2 is preferable in a range from 1.8 mm to 2.5 mm. The thickness t3 is preferable in a range from 1.8 mm to 2.5 mm. The thickness t4 is preferable in a range from 1.1 mm to 2.0 mm.

A position, at which the rib 110 serving as means for lowering the CT-value is provided, is set to be lower than the central position (FC) of the face portion 107A. In this case, preferably, the horizontal rib 110*a* is provided in a range of height higher than the height of the middle position between the central position (FC) of the face portion and the point P4. Consequently, the lower-side part of the face portion can widely be reinforced. Accordingly, the CT-value can efficiently be adjusted.

Hereinafter, the definitions of the central position (FC) and the height (H) of the face portion are described.

The central position (FC) of the face portion 7*a* is defined to be the midpoint (or center) between a crown-side face boundary point P3 and a sole-side face boundary point P4 on a middle perpendicular line passing through the center of a line segment having a maximum width L (i.e., the center between a heel-side face boundary point P1 and a toe-side face boundary point P2) in the toe-heel direction of the ball hitting surface. Incidentally, the face boundary points P1 to P4 are usually defined by edge parts or parts at which finishing (e.g., satin finishing, mirror finishing, blast finishing, and paint finishing) is changed. In a case where the face portion is continuously constituted by an R-curved surface, and where the central position of the face portion cannot be determined according to such criteria, the central position (FC) of the face portion is determined as follows. First, in a state in which the head is seen in front view, a horizontal line is drawn on a broadest part of a ball hitting portion. The boundary points P1 and P2 are specified by determining positions, at each of which curvature radius is less than that corresponding to R30, at the side of a heel and at the side of a toe. The width between the specified boundary points P1 and P2 is set to be a maximum width L. Then, a normal is drawn onto the midpoint on the line segment between the boundary points P1 and P2. Subsequently, the boundary points P3 and P4 are specified by determining positions, at each of which curvature radius is less than that corresponding to R10, on the normal. A midpoint between the boundary points P3 and P4 on the normal is set to be the central position (FC) of the face portion 107*a*.

Incidentally, an intersecting angle between a tangential line L1 passing through the central position (FC) of the face portion 107*a*, which is specified as described above, and a normal to the reference horizontal plane P is a loft angle β. The distance between the boundary points P3 and P4 on a straight line parallel to the tangential line L1 is a height H of the face portion.

The CT-value at a position lower than the central position (FC) of the face portion 107*a* is effectively lowered by forming the rib 110 at the sole-side of the rear surface of the face portion, as described above. Thus, the condition CTu/Ctc≦0.75 can be satisfied in a range within 12 mm downwardly from the central position of the face portion. More specifically, a test is performed using a golf club to which a head provided by forming the rib 110 on the rear surface of the face portion 7*a* is attached. Results of the test are described below.

In the structure of each of the heads illustrated in FIGS. 19 to 21, the thicknesses t1 to t4 of the face portion, the height of the rib 110 (i.e., a height of a horizontal rib h1, and a height h2 of a vertical rib) are changed. Additionally, the CT-value in the up-down direction, at the central position (FC) of the face portion 107*a*, is set to vary with the heads. Then, as is shown in a table 1 listed below, the CT-values at the central position (FC) of the face portion 107*a*, a position at a distance of 6 mm downwardly from the central position (FC) of the face portion, a position at a distance of 6 mm upwardly from the position FC, a position at a distance of 12 mm downwardly from the position FC, and a position at a distance of 12 mm upwardly from the position FC are measured. Incidentally, the speed of a ball hit at each of these positions is calculated by being represented by a ratio (%) to the speed of a ball hit at the position FC, which is assumed to be 100%.

Incidentally, in each of the heads, the capacity, the inertia moment in the up-down direction, and the height H of the face are set at 380 c.c., 2200 g·cm$^2$, and 48 mm, respectively. Additionally, balls of the same structure are hit by hitting-test-robots, to each of which a shaft of the same structure is attached, at a head speed of 40 m/s.

Then, ratios (CTu/CTc) and (CTt/CTc) are measured at a position at a distance of 6 mm downwardly from the central position (FC) of the face portion, a position at a distance of 6 mm upwardly from the position FC, a position at a distance of 12 mm downwardly from the position FC, and a position at a distance of 12 mm upwardly from the position FC. Incidentally, "CTc" designates the CT-value at the position FC of the f ace portion. "CTu" designates the CT-value at a position lower than the position FC of the face portion. "CTt" designates the CT-value at a position higher than the position FC of the face portion.

TABLE 1

| | | Example 1 | | Example 2 | | Example 3 | | Example 4 | |
|---|---|---|---|---|---|---|---|---|---|
| | | CT-Value ($10^{-6}$ Sec) | Speed of hit ball(%) | CT-Value ($10^{-6}$ Sec) | Speed of hit ball (%) | CT-Value ($10^{-6}$ Sec) | Speed of hit ball (%) | CT-Value ($10^{-6}$ Sec) | Speed of hit ball (%) |
| Ball Hitting Position (mm) | Upper 12 | 253 | 98.2 | 275 | 99.0 | 263 | 98.7 | 320 | 99.8 |
| | Upper 6 | 249 | 99.5 | 275 | 99.6 | 261 | 99.8 | 296 | 99.9 |
| | Center FC | 224 | 100.0 | 253 | 100.0 | 253 | 100.0 | 256 | 100.0 |
| | Lower 6 | 163 | 98.9 | 206 | 99.7 | 223 | 99.8 | 206 | 98.9 |
| | Lower 12 | 154 | 96.9 | 157 | 97.5 | 189 | 98.7 | 123 | 95.0 |
| CTu/CTc | Lower 6 | 0.728 | | 0.814 | | 0.881 | | 0.805 | |
| | Lower 12 | 0.688 | | 0.621 | | 0.747 | | 0.480 | |
| CTt/CTc | Upper 12 | 1.129 | | 1.087 | | 1.040 | | 1.250 | |
| | Upper 6 | 1.112 | | 1.087 | | 1.032 | | 1.156 | |
| Face Thickness (mm) | t1 | 2.4 | | 2.2 | | 2.3 | | 2.0 | |
| | t2 | 2.1 | | 1.9 | | 2.2 | | 1.8 | |
| | t3 | 2.2 | | 2.3 | | 2.0 | | 2.0 | |
| | t4 | 1.7 | | 1.3 | | 1.7 | | 1.3 | |
| Rib Height (mm) | h1 | 8.0 | | 9.0 | | 8.0 | | 8.0 | |
| | h2 | 4.0 | | 5.0 | | 4.0 | | 5.0 | |

| | | Comparative Example 1 | | Related Art | |
|---|---|---|---|---|---|
| | | CT-Value ($10^{-6}$ Sec) | Speed of hit ball (%) | CT-Value ($10^{-6}$ Sec) | Speed of hit ball (%) |
| Ball Hitting Position (mm) | Upper 12 | 335 | 100.0 | 217 | 95.4 |
| | Upper 6 | 310 | 100.1 | 244 | 98.5 |
| | Center FC | 256 | 100.0 | 241 | 100.0 |
| | Lower 6 | 200 | 98.9 | 214 | 100.8 |
| | Lower 12 | 110 | 95.0 | 200 | 100.0 |
| CTu/CTc | Lower 6 | 0.781 | | 0.888 | |
| | Lower 12 | 0.430 | | 0.830 | |
| CTt/CTc | Upper 12 | 1.309 | | 0.900 | |
| | Upper 6 | 1.211 | | 1.012 | |
| Face Thickness (mm) | t1 | 2.0 | | | |
| | t2 | 1.8 | | | |
| | t3 | 2.0 | | | |
| | t4 | 1.2 | | | |
| Rib Height (mm) | h1 | 11.0 | | | |
| | h2 | 6.0 | | | |

As is understood from the results of a hitting test, in the case of using the related golf club, when a ball is hit at a position at a distance of 6 mm downwardly from the position FC, the (specific) speed of the ball is 100.8%. When a ball is hit at a position at a distance of 12 mm downwardly from the position FC, the speed of the ball is 100.0%. As compared with the speed of the ball at the hitting of the ball at the central position (FC) of the face portion, there is substantially no reduction in the speed. Therefore, even in a case where a ball is hit at such a position (i.e., the position which is off the meat of the head) when a golfer actually hits the ball, the ball obtains the speed that is equal to or higher than the speed obtained when the ball is hit at the central position of the face portion. Consequently, the golfer makes a mistake that he feels that "a ball has squarely been hit".

However, when a ball is actually hit at such a position, a launch angle is low. Additionally, an amount of back spin due to the gear effect is large. Consequently, the expected flying distance cannot be obtained.

To solve these problems, the structure of the face portion is adapted so that the CT-value at a position lower than the central position (FC) is reduced from the CT-value obtained by using the related head, and that a region, which meets the condition CTu/Ctc≦0.75, is provided as described in the description of the embodiments 1 to 4. Consequently, the speed of a ball hit at a position lower than the central position (FC) can be set to be lower than 100%. That is, in a case where when a golfer actually hits a ball, the ball is hit at such a position (i.e., the position which is off the meat of the head), the speed of the ball is lower than that of a ball hit at the central position of the face portion. This enables the golfer to sensuously feel that the ball is hit at a position which is off the meat of the face portion of the club head. In addition, as described above, the launch angle is low. The amount of back spin is large. Further, the flying distance is reduced. Consequently, the flying distance, which is expected by the golfer when hitting a ball, coincides with an actual flying distance. Accordingly, the invention can enable the golfer to clearly sense that the ball is hit at the position which is off the meat of the face portion.

Meanwhile, as described above, the speed of a ball hit by a golfer can be lowered by setting the CT-value to below. However, in the case of setting the CT-value to be too low (more particularly, setting the value of the ratio (CTu/CTc) to be too low), the flying distance of a ball is too much reduced when the ball is hit at a position (e.g., a position lower than the central position of the face portion) which is off the meat of the face potion. Thus, the characteristic of a head serving as a large head is deteriorated. This is unfavorable. One of characteristics demanded by ordinary golfers resides in that even when a ball is hit by such a head at a position which is slightly off the meat of the face portion of the head, a flying distance, which is satisfactory to some extent, can be obtained. More specifically, such a characteristic cannot be obtained when the specific speed of the ball hit by the head is less than 95% (see results in the case of Example 4 and Comparative Example 1). Preferably, the value of the ratio (CTu/CTc) is set to meet the condition 0.48≦(CTu/CTc).

On the other hand, in consideration of the case of hitting a ball at a position which is off upwardly from the central position (FC) of the face portion, the ballistic efficiency (e.g., the amount of spin, and a flying distance efficiency corresponding to a launch angle) is favorable. Preferably, the speed of a ball hit by the head is increased by increasing the CT-value (i.e., increasing the ratio (CTt/CTc)). In a case where the speed of the ball hit by the head is too much increased, and where the specific speed of the ball hit by the head exceeds 100% as compared with the speed of a ball hit at the central position of the face portion (see the result of Comparative Example 1), a golfer tends to fail to sense the central position. Therefore, preferably, the speed of a ball hit at a position higher than the central position (FC) of the face portion is set to be close to 100%. More preferably, the speed of a ball hit at a position higher than the central position (FC) of the face portion is set to be within a range in which the specific speed of the ball does not excess 100%. More specifically, it is preferable that the face portion has a region which meets the condition CTt/CTc≧1.04 in a range within 12 mm upwardly from the central position of the face portion, where CTt designates the CT-value at the position upper than the central position of the face portion (seethe result in the case of Example 3). More preferably, the face portion has a region which meets the condition CTt/CTc≦1.25 (see Example 4).

According to the golf club in which the face portion of the head has the aforementioned characteristic, when a ball is hit by a position which is off the central position (FC) of the face portion, tendency is to make a flying distance, which is expected by a golfer when hitting the ball, coincide with an actual flying distance. Thus, the golfer learns to hit a ball by a part (i.e., a central region of the face portion, from which a maximum flying distance can be obtained) of the face portion, at which a maximum flying distance can be expected. Consequently, the flying distance can be increased.

The invention is featured by designing the head so that the CT-values respectively at the central position (FC) of the face portion of the head and to positions located upwardly or downwardly from the central position FC are predetermined rates. Practical means for increasing or decreasing the CT-value can appropriately be changed. More specifically, for example, in a case where the head has a structure in which the rib is formed on the rear surface of the face portion, it is advisable to design the head so that the aforementioned conditions expressed by inequalities in terms of the ratios of the CT-Values are satisfied by changing the shape, the height, the thickness, and the formation position of the rib. Additionally, the characteristic of the head, which is a large head, can be improved by changing a method of forming the rib.

For example, the modification of the shape of the rib illustrated in each of FIGS. 17A to 17F described above can be employed. According to the rib illustrated in FIG. 17B, when a ball is hit by mistake at a toe-side part of the head, the trajectory of a golf ball can be stabilized by utilizing the flexibility of the face, without increasing the launch angle. Also, the CT-values respectively at a toe-side position and a heel-side position can be maintained at high values. Thus, the invention has a merit that reduction in the flying distance of a ball hit by mistake at a toe-side part or a heel-side part of the head is small.

As described above, the specific strength and the specific rigidity of the lower-side region of the face portion can be changed by modifying the shape of the rib. Also, the ball-hitting-feeling at the hitting of a ball at a lower part of the face can be adjusted.

Alternatively, the head can be designed to satisfy the aforementioned conditions, by changing the thickness and the material of the face portion, or modifying the structure (e.g., the thickness and the material) of the components (e.g., the crown portion and the sole portion) other than the face portion, in addition to the formation of the rib.

What is claimed is:

1. A golf club, comprising:

a shaft; and a head having a hollow structure fixed to an end of the shaft so as to be set to have a predetermined lie angle and a predetermined loft angle with respect to a reference horizontal plane, wherein the head includes:

a face portion which includes a ball hitting surface by which a ball is hit;

a crown portion;

a side portion;

a sole portion; and a rib provided at a part, which is lower than a central part of the face portion, on an inner surface of the face portion to protrude toward a center of the head, said rib comprising a transverse rib portion extending along a toe-heel direction, and a plurality of longitudinal rib portions, extending along a crown-sole direction, which are confined between said transverse rib portion and the sole portion, wherein a portion of the inner surface of the face portion, located above the transverse rib, comprises a central part and a peripheral part, said peripheral part confining said central part, having a thickness less than a thickness of the central part, and contacting an upper surface of the transverse rib.

2. The golf club according to claim 1, wherein the face portion includes a face member to be connected by a connecting portion, and the connecting portion of the face member is formed on the ball hitting surface and is formed at a position at which at least the transverse rib is provided.

3. The golf club according to claim 1, wherein the rib is formed integrally with at least one of the side portion and the sole portion which adjoins/adjoin the face portion.

4. The golf club according to claim 1, wherein a position, at which the rib is provided, is confined within a range from 0.2 H to 0.5 H, where H is a maximum height of the face portion.

5. The golf club according to claim 1, wherein the head is constituted so that a maximum resilience position (IS) of the face portion in an upper region, in which the rib is not formed, is located closer to a toe-side than a sweetspot (SS).

6. The golf club according to claim 5, wherein the upper region, in which the rib is not formed, on the face portion has a thick part at a central part thereof, and a thin part around the thick part.

7. The golf club according to claim 1, wherein the crown portion is formed so that a rigidity of the crown portion is lower than a rigidity of the sole portion.

8. The golf club according to claim 1, wherein the rib is formed integrally with the side portion and the sole portion which adjoin the face portion.

9. The golf club according to claim 1, wherein said plurality of longitudinal rib portions comprises a central longitudinal rib portion which is longer than longitudinal rib portions disposed on both sides of the central longitudinal rib portion.

10. The golf club according to claim 1, wherein a sole-side edge part of the face portion is connected to a step-like portion formed at a front end side of the transverse rib, other than being bent-formed.

11. The golf club according to claim 1, wherein a sectional area of the transverse rib is greater than a sectional area of each of the longitudinal rib portions.

12. A golf club, comprising:

a shaft; and a head of a hollow structure fixed to an end of the shaft so as to be set to have a predetermined lie angle and a predetermined loft angle with respect to a reference horizontal plane, wherein the head includes:

a face portion which includes a ball hitting surface by which a ball is hit;

a crown portion;

a side portion;

a sole portion; and a rib which is formed integrally with at least one of the side portion and the sole portion which adjoins/adjoin the face portion, and is provided at a part, which is lower than a central part of the face portion, on an inner surface of the face portion to protrude toward a center of the head, said rib comprising a transverse rib portion extending along a toe-heel direction, and a plurality of longitudinal rib portions, extending along a crown-sole direction, which are confined between said transverse rib portion and the sole portion, wherein a portion of the inner surface of the face portion, located above the transverse rib, comprises a central part and a peripheral part, said peripheral part confining said central part, having a thickness less than a thickness of the central part, and contacting an upper surface of the transverse rib.

13. The golf club according to claim 12, wherein the rib is provided at an attachment portion formed integrally with at least one of the side portion and the sole portion which adjoins/adjoin the face portion, and the face portion includes a face member fixedly attached to the attachment portion.

14. The golf club according to claim 13, wherein a gap portion is formed in the attachment portion.

15. The golf club according to claim 12, wherein the face member is formed integrally with the crown portion.

16. The golf club according to claim 12, wherein the attachment portion is formed integrally with the side portion and the sole portion which adjoin the face portion.

17. The golf club according to claim 12, wherein the rib is formed integrally with the side portion and the sole portion which adjoin the face portion.

18. The golf club according to claim 12, wherein a position, at which the rib is provided, is confined within a range from 0.2 H to 0.5 H, where H is a maximum height of the face portion.

19. The golf club according to claim 12, wherein a sole-side edge part of the face portion is connected to a step-like portion formed at a front end side of the transverse rib, without being bent-formed.

20. The golf club according to claim 12, wherein the face portion includes a face member that is connected by a connecting portion, the connecting portion being formed on the ball hitting surface and at a position where at least the transverse rib is provided.

21. The golf club according to claim 12, wherein a sectional area of the transverse rib is greater than a sectional area of each of the longitudinal rib portions.

22. A golf club, comprising:

a shaft; and a head having a hollow structure fixed to an end of the shaft so as to be set to have a predetermined lie angle and a predetermined loft angle with respect to a reference horizontal plane, wherein the head comprises:

a face portion which includes a ball hitting surface by which a ball is hit;

a crown portion;

a side portion;

a sole portion; and a rib provided at a part, which is lower than a central part of the face portion, on an inner surface of the face portion to protrude toward a center of the head, wherein a position, at which the rib is provided, is confined within a range from 0.2 H to 0.5 H, where H is a maximum height of the face portion, wherein a portion of the inner surface of the face portion, located above the rib, comprises a central part and a peripheral part, said peripheral part confining said central part, having a thickness less than a thickness of the central part, and contacting an upper surface of the rib.

23. The golf club according to claim 22, wherein a sole-side edge part of the face portion is connected to a step-like portion formed at a front end side of a transverse rib of said rib, other than being bent-formed.

24. The golf club according to claim 22, wherein the face portion includes a face member that is connected by a connecting portion, the connecting portion being formed on the ball hitting surface and at a position where at least a transverse rib of said rib is provided.

25. The golf club according to claim 22, wherein a sectional area of a transverse rib of said rib is greater than a sectional area of each of a longitudinal rib portions of said rib.

* * * * *